US008535128B2

(12) United States Patent
Chwala

(10) Patent No.: US 8,535,128 B2
(45) Date of Patent: Sep. 17, 2013

(54) HINGE ASSEMBLY FOR SUPPORTING A FAN ON A ROOF

(71) Applicant: Omni Containment, LLC, Elgin, IL (US)

(72) Inventor: Kevin R. Chwala, Elgin, IL (US)

(73) Assignee: Omni Containment, LLC, Elgin, IL (US)

( * ) Notice: Subject to any disclaimer, the term of this patent is extended or adjusted under 35 U.S.C. 154(b) by 18 days.

(21) Appl. No.: 13/622,641

(22) Filed: Sep. 19, 2012

(65) Prior Publication Data

US 2013/0017775 A1 Jan. 17, 2013

Related U.S. Application Data

(63) Continuation of application No. 12/931,311, filed on Jan. 28, 2011, which is a continuation-in-part of application No. 12/657,918, filed on Jan. 29, 2010, which is a continuation-in-part of application No. 11/551,285, filed on Oct. 20, 2006, now abandoned.

(51) Int. Cl.
*F24F 7/06* (2006.01)

(52) U.S. Cl.
USPC ..... 454/354

(58) Field of Classification Search
USPC ..... 454/356, 364, 365, 136, 15
See application file for complete search history.

(56) References Cited

U.S. PATENT DOCUMENTS

| | | | | | |
|---|---|---|---|---|---|
| 2,372,164 | A * | 3/1945 | Woodhams | 454/94 |
| 3,846,938 | A * | 11/1974 | Kelly | 49/342 |
| 3,861,083 | A * | 1/1975 | Goiot | 49/193 |
| 3,934,383 | A * | 1/1976 | Perry et al. | 52/200 |
| 3,975,793 | A | 8/1976 | Just | |
| 4,038,911 | A * | 8/1977 | Hart | 454/94 |
| 4,615,263 | A * | 10/1986 | Titterud | 454/94 |
| 4,633,769 | A * | 1/1987 | Milks | 454/117 |
| 4,845,905 | A * | 7/1989 | Frank | 52/72 |
| 4,890,950 | A | 1/1990 | Yoo | |
| 4,941,300 | A * | 7/1990 | Lyons, Jr. | 52/58 |
| 4,977,884 | A | 12/1990 | Kaufman | |
| 4,987,882 | A | 1/1991 | Kaufman | |
| 5,185,941 | A | 2/1993 | Dongelmans | |
| 5,311,857 | A | 5/1994 | Chang | |
| 5,337,994 | A | 8/1994 | Vipond et al. | |
| 5,568,702 | A * | 10/1996 | Frank et al. | 49/153 |
| 5,816,909 | A | 10/1998 | Wunder | |
| 5,874,292 | A | 2/1999 | McMinn | |
| 6,274,375 | B1 | 8/2001 | McMinn | |
| 6,289,555 | B1 * | 9/2001 | Nguyen et al. | 16/235 |
| 6,450,874 | B2 | 9/2002 | Hoyez | |
| 6,716,099 | B2 | 4/2004 | Pfieiderer | |
| 7,004,832 | B2 * | 2/2006 | Thomas | 454/94 |
| 2004/0043722 | A1 * | 3/2004 | Richter | 454/358 |
| 2004/0235412 | A1 * | 11/2004 | Ramsay | 454/368 |
| 2005/0003751 | A1 * | 1/2005 | Thomas | 454/136 |

FOREIGN PATENT DOCUMENTS

| | | |
|---|---|---|
| DE | 2632969 | 1/1978 |
| JP | 2001048208 | 2/2001 |

* cited by examiner

*Primary Examiner* — Steven B McAllister
*Assistant Examiner* — Samantha Miller
(74) *Attorney, Agent, or Firm* — Adam K. Sacharoff

(57) ABSTRACT

A buttressed hinge assembly or a flexible hinge assembly adjusts to fit a vent on a wall or a roof in order to hold a fan thereon, which fan is especially suitable for a restaurant roof or wall. The hinge assembly attaches to a roof or wall vent to hold the fan in a proper position, yet permits the fan to be easily moved for cleaning of vent and the fan.

15 Claims, 22 Drawing Sheets

314
344

314
346

314
348

314
350

HINGE ASSEMBLY FOR SUPPORTING A FAN ON A ROOF

CROSS REFERENCE TO RELATED APPLICATIONS

This application is a continuation of U.S. application Ser. No. 12/931,311 filed Jan. 28, 2011, which is a continuation in part of U.S. application Ser. No. 12/657,918 filed Jan. 29, 2010, which is a continuation in part of U.S. application Ser. No. 11/551,285 filed Oct. 20, 2006. All of which are incorporated by reference in their entirety.

This invention relates to a hinge assembly for supporting a fan on a roof and, more particularly, to a buttressed or flexible hinge assembly, which supports the fan on the roof, while providing for an easy cleaning procedure for both the fan and the vent on the roof.

BACKGROUND OF THE INVENTION

Ventilation is very important in a building. To that end, at least one fan may be installed in order to assist air circulation. In a large building, the fan is required to be quite powerful. This power requirement leads to large and heavy fans. Typically, such a fan is mounted over a vent on a roof. By moving air through the vent, both the vent and the fan will become contaminated. When a fan or a vent is contaminated, air flow is compromised.

Most hinge systems are fastened to the fan by attaching hardware in a very concentrated and limited area on the fan base and duct. This causes a great deal of stress in the affected area, which leads to equipment breakdown and damage to the fan housing. In fact, current hinge systems can be installed only on fans, which that have a configuration that matches up with those of the hinge system. These hinge systems are operable only with a small percentage of the fans in use today and cannot be modified to adapt to other fans.

It is thus desirable to clean the fan and improve the air flow. As the fan size increases, movement thereof becomes even more difficult, which further complicates the cleaning process. Movement of the fan for cleaning and service purposes must therefore be simplified.

Cleanliness is also very important in the restaurant business. The more easily such cleanliness can be achieved, the more profitable and efficient restaurant can be. Critical to achieving these desired advantages is providing effective and simplified access to areas which need to be cleaned. This is especially critical with the vents at the restaurant.

Because of new mandates requiring commercial food processing facilities and all restaurants to install a hinging system on their roof top ventilators, it is important for these businesses to find a system that can adapt to their specific needs. The only hinging systems available are compatible with just a small percentage of existing roof top ventilation systems. The effectiveness of these systems, and in many cases the possibility of installing them at all, is limited by a number of factors including the weight and dimensions of the fan, low grade material and components, which leads to a lack of durability, and a lack of versatility, meaning an inability to adapt to a variety of different situations that may be involved with hinge installation on any given fan.

Typically, a vent at a restaurant permits an exhaust to be withdrawn from the kitchen. Assisting the exhaust is usually a fan. This vent generally passes from the kitchen through the roof. Mounted on the kitchen roof over the vent is usually a fan. Through this vent, are generally passed grease and other cooking residue.

After a period of use, this vent and the fan become contaminated with that grease. Other cooking residue also becomes adhered thereto. This basically flammable residue is at least a fire hazard, or worse. Such residue can also attract undesirable microbes and illness causing bacteria. The closeness of such contamination to a food source is a clear danger to those food consumers and food handlers, who are at the restaurant.

It is thus necessary to clean both the vent and the fan after a period of use. While the fan is necessary for the vent to work, the fan causes many problems, when the time to clean the vent and the fan comes. Any device, which simplifies removal of such contamination and cleaning of the affected area, provides many great advantages. Still, there are many problems with such a cleaning process and the related device.

A first problem is that the fan must be moved, in order to clean the vent. A properly mounted fan is difficult to move and reinstall properly. The mounting for the fan must be solid enough to hold the fan, while leaving the fan easily movable for cleaning purposes. This fan must also be simple to reinstall in order for that fan to function with the exhaust vent in a proper fashion.

To that end, a restaurant fan is sometimes mounted on a hinge. The hinges of the prior art weaken the mounting of the fan, especially if the fan is easily movable. If the hinge is strong enough to firmly support the fan, the fan is not easily moved, and access to the vent becomes more complicated.

The hinge kits of the prior art are constructed from thin gauge steel and inadequate hardware. This leads to premature equipment failure and can cause the fan to overextend or even fall off of the duct. Most hinges cannot support the weight of heavier fans.

Current hinges use holding devices such chains, cables, or similar devices to prevent fans from falling backwards. These components are the source of a number of problems. First, those holding devices, especially the chains, have a tendency to fail. When they do fail, the fan can fall backward violently, damaging the fan and posing an injury risk. They must be precisely measured and installed, adding a time-consuming factor to the installation process. Also they are a major inconvenience and obstruction to workers that clean and service the fan.

With the many variations in a roof and the plurality on different fan structures, adjustability of the hinge is also desired. Yet obtaining adjustability can interfere with both strength and access to both the fan and the vent. Emphasizing one desired feature can interfere with the other.

Thus, it is very desirable to provide access to the vent, while supporting the fan on the roof at the same time. It is also very useful if the hinge assembly can be adjustable.

SUMMARY OF THE INVENTION

Among the many objectives of this invention is the provision of a buttressed hinge assembly, which supports a fan on a roof, while providing for an easy cleaning procedure for both the fan and the vent on the roof.

A further objective of this invention is the provision of a buttressed hinge assembly, which greatly simplifies cleaning of a vent for a restaurant.

Yet a further objective of this invention is the provision of a buttressed hinge assembly, which greatly simplifies cleaning of a fan.

A still further objective of this invention is the provision of a buttressed hinge assembly, which is easily adjustable on a roof.

Another objective of this invention is the provision of a buttressed hinge assembly, which is strong.

Yet another objective of this invention is the provision of a buttressed hinge assembly, which support the fan.

Still, another objective of this invention is the provision of a buttressed hinge assembly, which simplifies cleaning of the fan.

Also, an objective of this invention is the provision of a buttressed hinge assembly, which simplifies cleaning of the vent.

A further objective of this invention is the provision of a flexible hinge assembly with a rotational lower bar which can accommodate a variety of fan to duct combinations.

A still further objective of this invention is the provision of a flexible hinge assembly which can balance the weight of the fan behind the fan base, the fan, and the vent wall.

Another provision of this invention is the provision of a flexible or buttressed hinge assembly which eliminates the safety concerns of removing the fan from the vent wall and placing it directly on a roof top.

These and other objectives of the invention (which other objectives become clear by consideration of the specification, claims and drawings as a whole) are met by providing a buttressed hinge assembly, which adjusts to fit a roof in order to hold a fan thereon, which is especially suitable for a restaurant roof.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
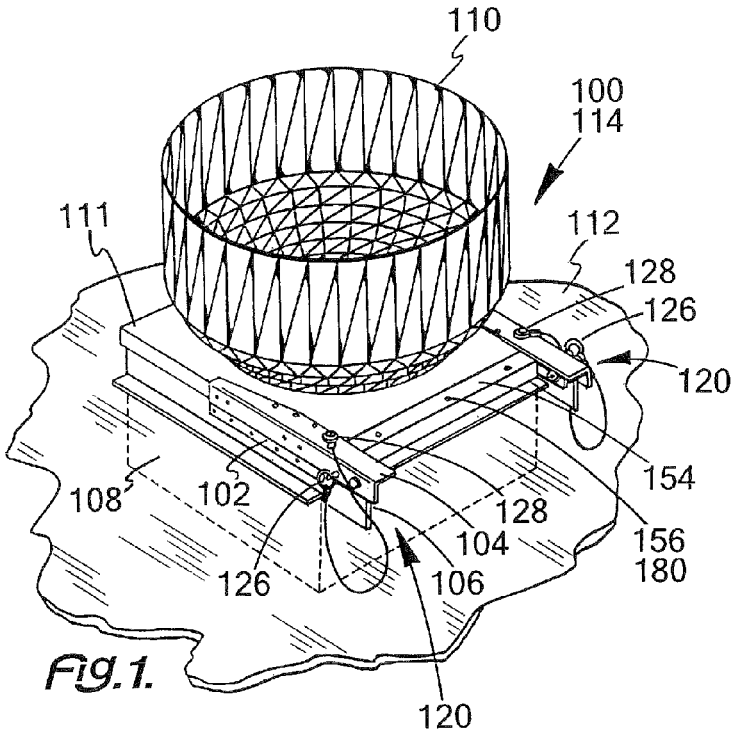
FIG. 1 depicts a perspective view of a buttressed hinge assembly 100 of this invention for supporting a fan 110 on a roof 112 in a closed hinge position 114.
Figure 2:
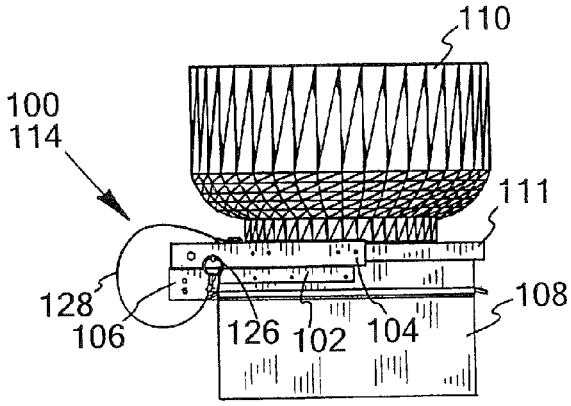
FIG. 2 depicts a side view for buttressed hinge assembly 100 of this invention based on FIG. 1.
Figure 3:
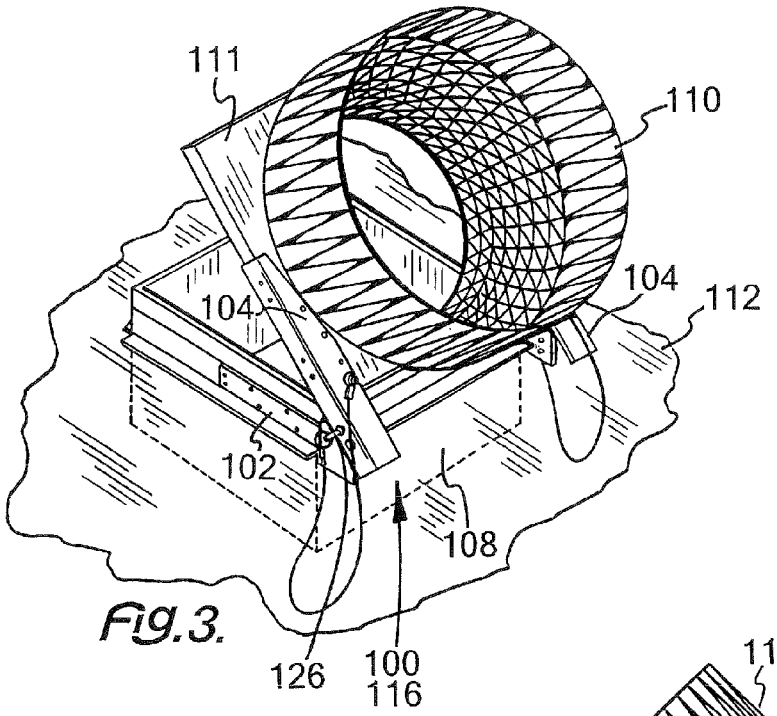
FIG. 3 depicts a perspective view of buttressed hinge assembly 100 of this invention in partially opened hinge position 116.
Figure 4:
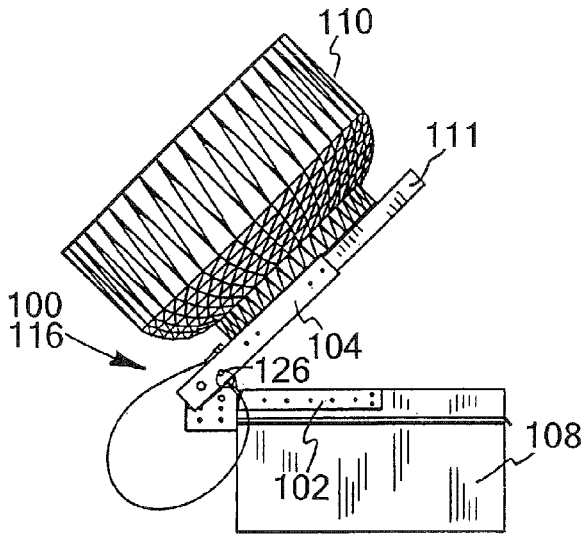
FIG. 4 depicts a side view for buttressed hinge assembly 100 of this invention based on FIG. 3.
Figure 5:
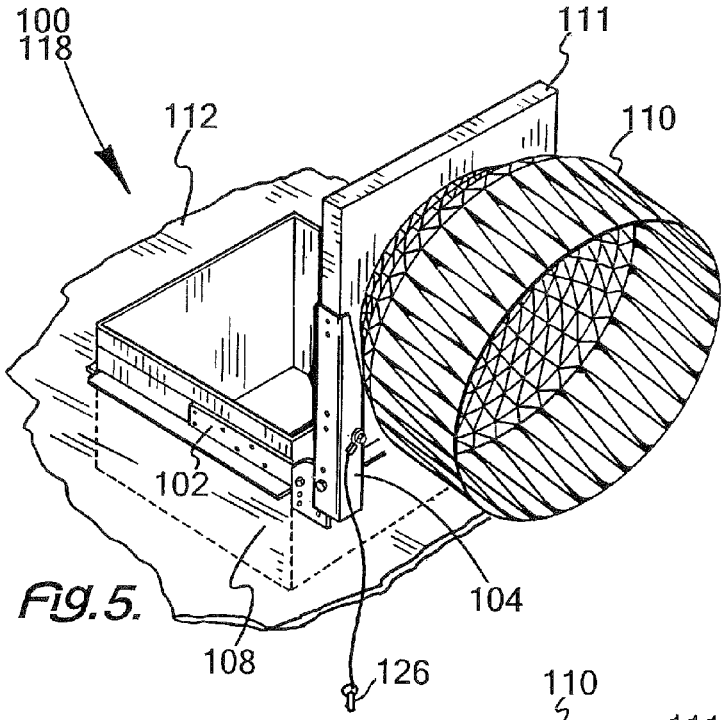
FIG. 5 depicts a perspective view of buttressed hinge assembly 100 of this invention in fully opened hinge position 118.
Figure 6:
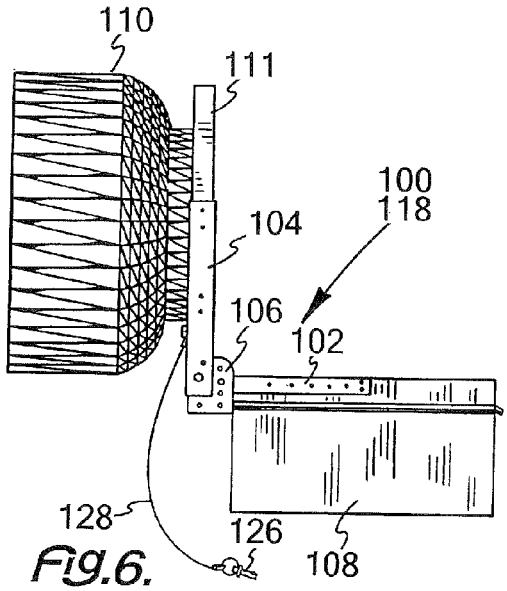
FIG. 6 depicts a side view for buttressed hinge assembly 100 of this invention based on FIG. 5.
Figure 7:
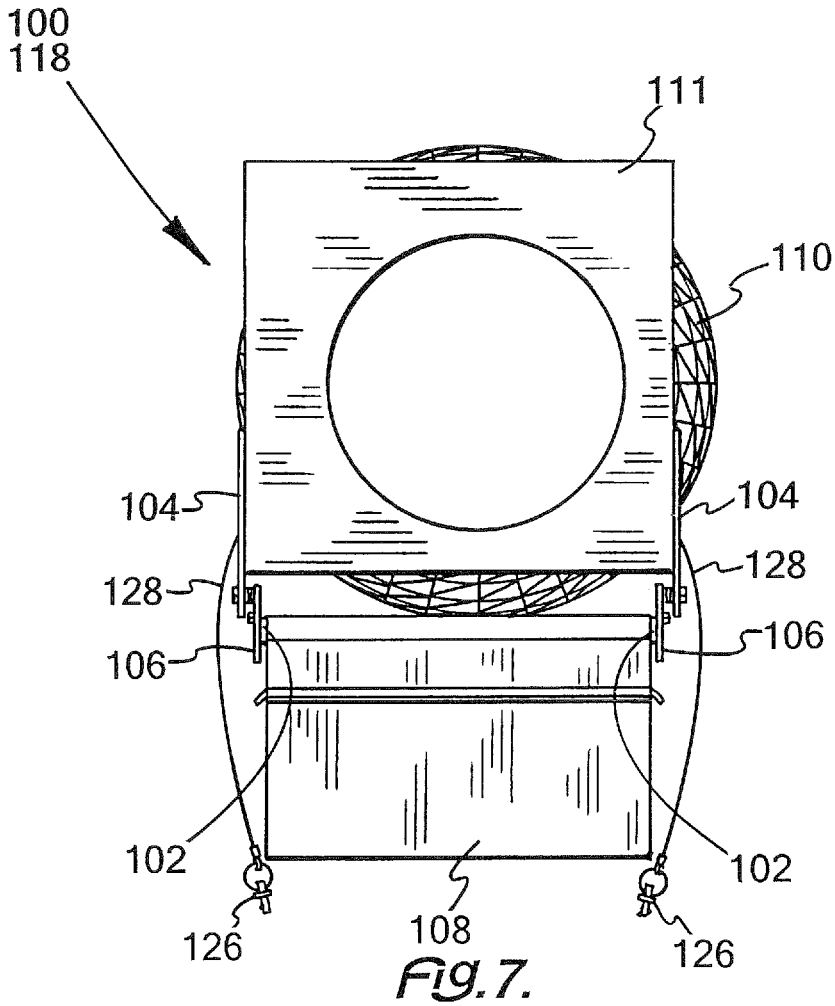
FIG. 7 depicts a bottom view of fan base 111 for buttressed hinge assembly 100 of this invention.

In accordance with the present invention, the buttressed hinge assembly is depicted. The buttressed hinge assembly consists of a mounting support bar and a fan support bar connected together through a hinge. The fan support bar is also connected to the fan in order to hold the fan in a position and within a relationship to the roof duct. The hinge allows that fan to be securely held in multiple positions to provide easier access to the fan and duct walls during cleaning, while at the same providing a strong support for the fan as it works in a proper position on the roof.

This hinge is fastened and clamped over a much larger area of the fan base and duct. This causes stress to be more evenly distributed, which protects the fan housing and prolongs the life of the hinge system. This hinge can be installed on most fans and has a number of adjustment capabilities that allow it to be installed on almost all other fan duct combinations.

This hinge is preferably made of rust resistant heavy grade steel and the assembly thereof is accomplished with rust resistant hardware. Preferably, the hinge is powder coated to resist rust. Hardware is preferably made from hardened stainless steel. This hinge uses a holding pin to lock the fan in place. It is strong and easy to install, and is completely out of the way of service providers. An additional benefit is that the fan can be locked into position at a 45-degree angle as well as a 90-degree angle, which makes it easier for service personnel to clean and service it. This hinge can handle fans weighing about 200 to 300 kilograms or more.

The hinge assembly of this invention is extremely useful for holding a heavy fan of any type in a desired position over a vent. The fan can be easily moved and support, so that both the fan and the vent are more easily cleaned. This is especially effective, for cleaning a fan on the roof of a restaurant, where grease from the cooking processes complicate the cleaning process.

The buttressed hinge assembly and the flexible hinge assembly provide another great safety feature. Previously, the fan would be completely removed from the vent and placed on the roof top. This method provided many safety concerns. First, the power conduit leads to the fan would be damaged, causing exposed wires or shorted wires. The damage from the power conduits would be caused by awkward tensions on the conduit when removing the fan unhinged. These damaged conduits cause great fire hazards when placed on a roof top which under most circumstance are greasy due to exhaust fan smoke and grease discharge. Furthermore, place heavy fans on the roof top caused damage and punctures or holes in the roof top. The hinge assembly of this invention eliminates all of these safety concerns.

Furthermore, other than providing ease of use and addressing safety concerns, the laws of many, if not all states, require a hinge assembly which can move the fan and can also be secured in a lock down position. So, the hinge assembly of this invention also allows the user to be in compliance with the law.

Referring now to FIG. 1, FIG. 2, FIG. 3, FIG. 4, FIG. 5, FIG. 6, and FIG. 7, the structure of buttressed hinge assembly 100 of this assembly can be clearly seen. Buttressed hinge assembly 100 has mounting support bar 102 and fan support bar 104. Buttressed hinge assembly 100 has mounting support bar 102 and fan support bar 104, which are mutually connected through their attachment on hinge locking plate 106 to form hinge 120.

Mounting support bar 102 is designed to attach to the duct or vent wall 108 on a roof 112. Vent wall and duct are used interchangeable and refer to the same component. Fan support bar 104 is also designed to attach to fan base 111, which supports fan 110 and provide for a temporary hinged movement of the same. Hinge locking plate 106 is between mounting support bar 102 and fan support bar 104. Hinge locking plate 106 provides a cam action between mounting support bar 102 and fan support bar 104.

Hinge locking plate 106 includes adjustment apertures 158, in order provide flexibility in the positioning of mounting support bar 102. Hinge bolt 162 permits movement of fan support arm 104 relative to mounting support bar 102. Plate bolt 164 secures mounting plate 106 to mounting support bar 102. Hinge nut 166 secures hinge bolt 162 in position to movably connect fan support arm 104 and mounting support bar 102. Plate nut 168 secures hinge locking plate 106 to mounting support bar 102 through plate bolt 164.

Figure 13:
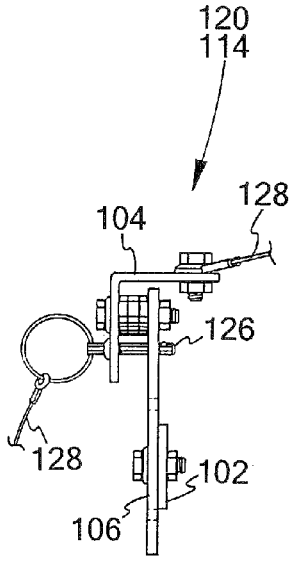
FIG. 13 depicts a rear plan view of side hinge 120 for buttressed hinge assembly 100 of this invention based on FIG. 3.
Figure 12:
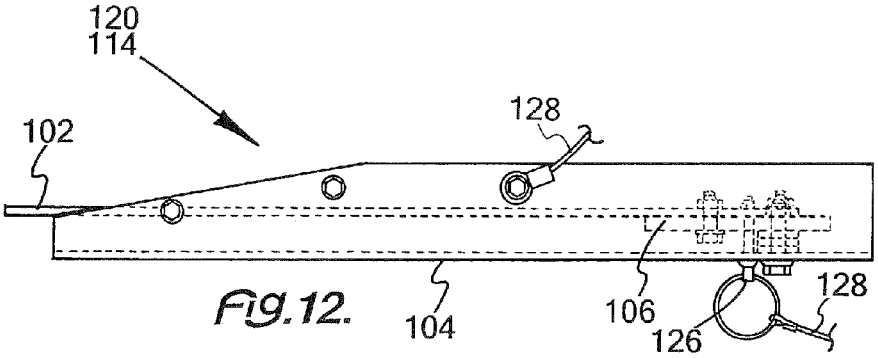
FIG. 12 depicts a top plan view of side hinge 120 for buttressed hinge assembly 100 of this invention based on FIG. 3.

If desired, one or more of shim 160 (FIG. 7, FIG. 12 and FIG. 13) may be placed on hinge bolt 162 in order to space fan support arm 104 from mounting support bar 102. This is another factor providing flexibility and adjustability to the buttressed hinge assembly 100, especially in the positioning of fan 110 relative to vent wall 108.

As an option, mounting bar brace 154 may connect a pair of mounting support bars 102 in a U-shape. The connection is by welding, bolting or other suitable fasteners. This structure may add strength to the buttressed hinge assembly 100. So it is possible that mounting bar brace 154 may include brace apertures 156, which can receive fasteners 142 in order to secure mounting bar brace 154 and the pair of mounting support bars 102 to the vent wall 108.

Adding FIG. 8, FIG. 9, FIG. 10, FIG. 11, FIG. 12, and FIG. 13 to the consideration, along the length of mounting support bar 102 is a series of mounting bar securing apertures 140. Mounting bar securing apertures 140 are designed to cooperate with fastening device 142 (FIG. 14); in the form of hinge bolt 162, plate bolt 164, hinge nut 166 and plate nut 168; to secure the buttressed hinge assembly 100 to the fan 110.

Figure 9:
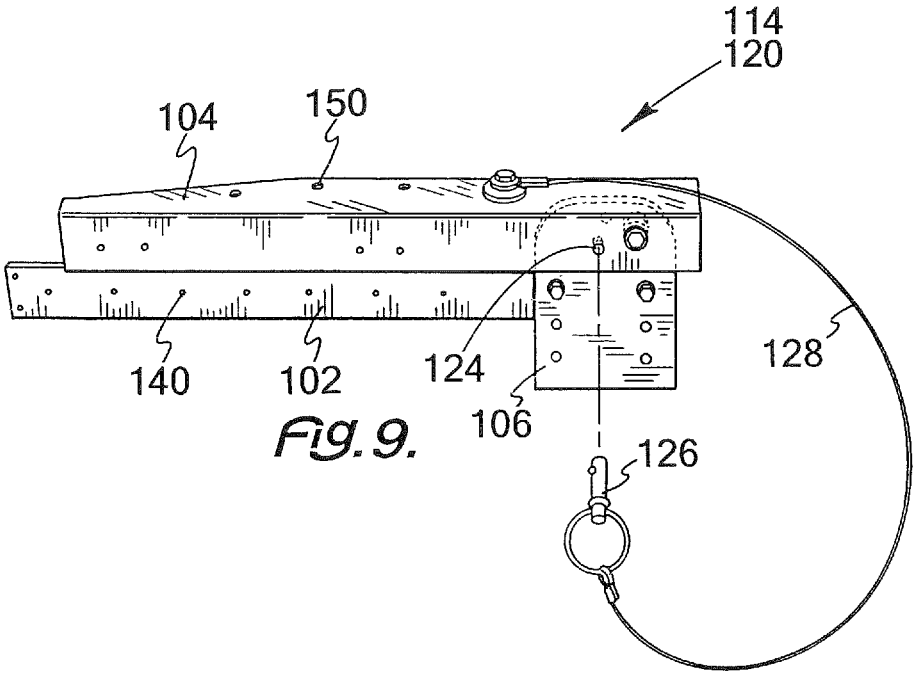
FIG. 9 depicts a perspective view of side hinge 120 for buttressed hinge assembly 100 of this invention based on FIG. 1.
Figure 10:
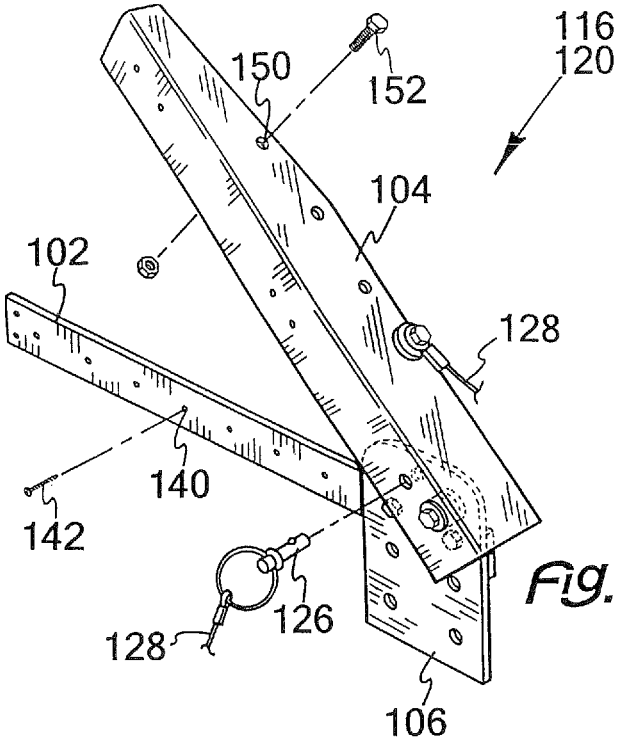
FIG. 10 depicts a perspective view of side hinge 120 for buttressed hinge assembly 100 of this invention based on FIG. 3.
Figure 11:
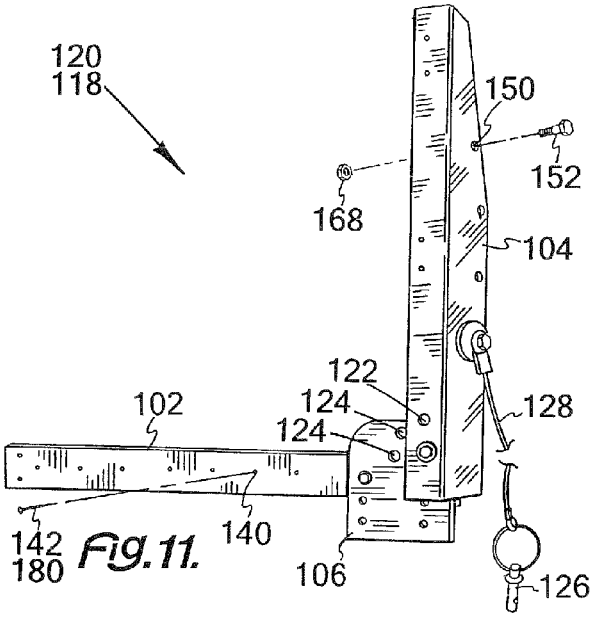
FIG. 11 depicts a perspective view of side hinge 120 for buttressed hinge assembly 100 of this invention based on FIG. 5.

More particularly, mounting support bar 102 is secured with plate bolt 164 and plate nut 168 to duct wall 108 in a secure and stable manner as in FIG. 9. Mounting bar securing apertures 140 cross a majority of the length of mounting support bar 102 so that stress from the weight of the fan 110 is not concentrated in one area. This increases the life and efficiency of buttressed hinge assembly 100.

In a similar fashion hinge 162 and hinge nut 164 cooperate to join fan support bar 104 and mounting support bar 102 in at least a partially rotational relationship. Mounting support bar 102 is fixed to vent wall 108, with fan support bar 104 movable relative thereto, so that fan 110 is movable for cleaning and other purposes.

Figure 8:
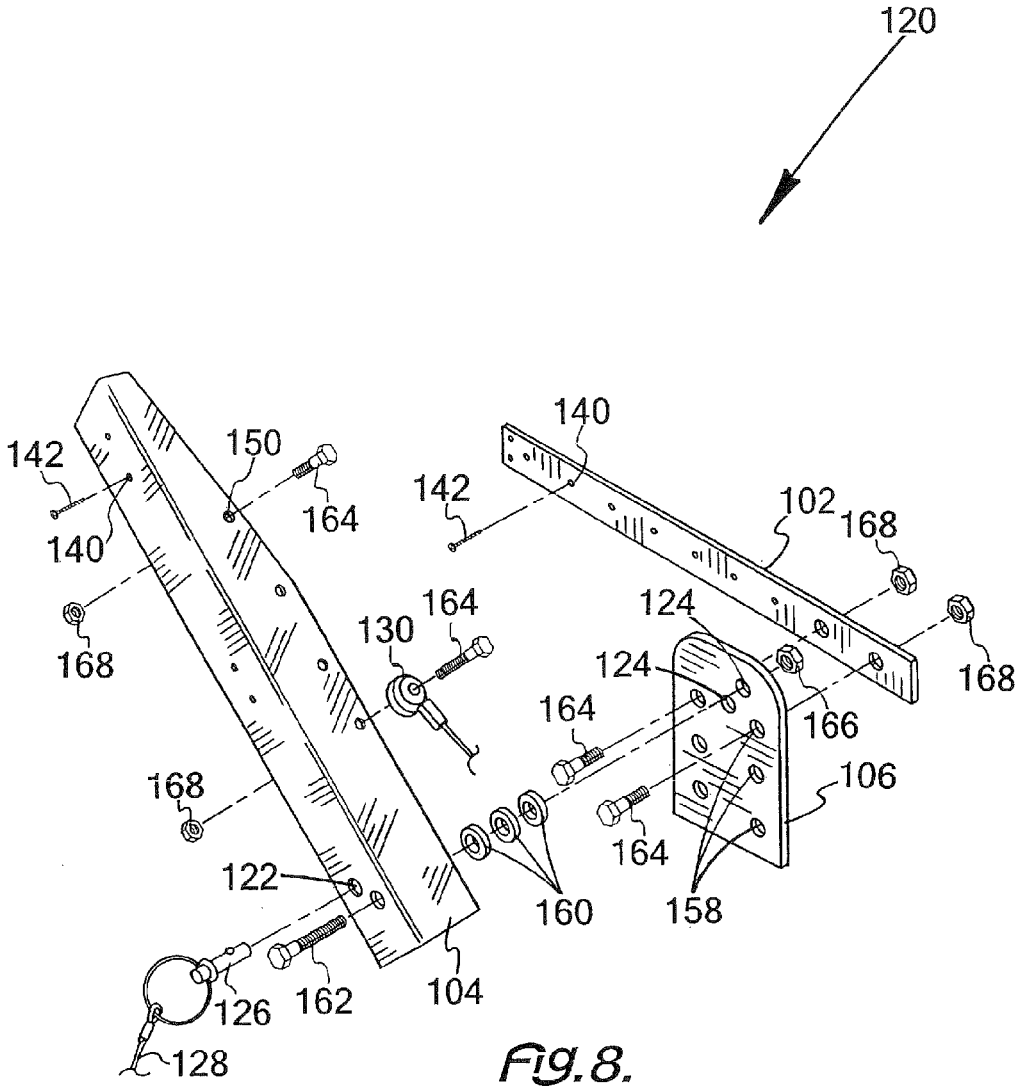
FIG. 8 depicts an exploded, perspective view of a buttressed hinge assembly 100 of this invention with fan 110 in a partially opened hinge position 116.

Along the length of fan support bar 104 is a series of fan support bar securing apertures 150. Fan support bar securing apertures 150 are designed to cooperate with fan fastening device 152 to secure fan 110 to fan support bar 104 in a secure and stable attachment as shown in FIG. 8. Fan support bar securing apertures 150 cross a majority of the length of fan support bar 104 so that the stress from the weight of the fan 110 is not concentrated in one area, thus increasing the life and efficiency of buttressed hinge assembly 100. This factor also increases the flexibility of buttressed hinge assembly 100 because heavier fans can be supported.

Furthermore, hinge 120 and locking pin 126 allow fan 110 to be repositioned in order to facilitate cleaning. Locking pin 126 is held to fan support bar 104 by flexible line 128. Oppositely disposed form locking pin 126, line fastener 130 cooperates with a holding device such as a rivet or a plate nut 168 and a plate bolt 164 in order to hold flexible line 128 on fan support bar 104. However, fan 110 can be moved, but does not have to be removed from hinge 120, thus making it much easier to clean both fan 110 and duct wall 108.

Once mounting support bar 102 is securely fastened to duct wall 108, fan support bar 104 can be locked in place at either a 45-degree angle (partially opened hinge position 116) or a 90-degree angle (fully opened hinge position 118). Hinge 120 allows for this variation in position. On hinge 120 are hinge locking pin apertures 127 and on fan support bar 104 are fan support bar locking pin apertures 124.

The user places fan 110 at either the 45-degree or 90-degree position and aligns fan support bar locking pin aperture 124 and hinge locking pin aperture 122 and secures the position by sliding locking pin 126 through the thus aligned apertures. With each set of apertures either the partially opened hinge position 116 or the fully opened hinge position 118 may be set as desired.

Figure 14:
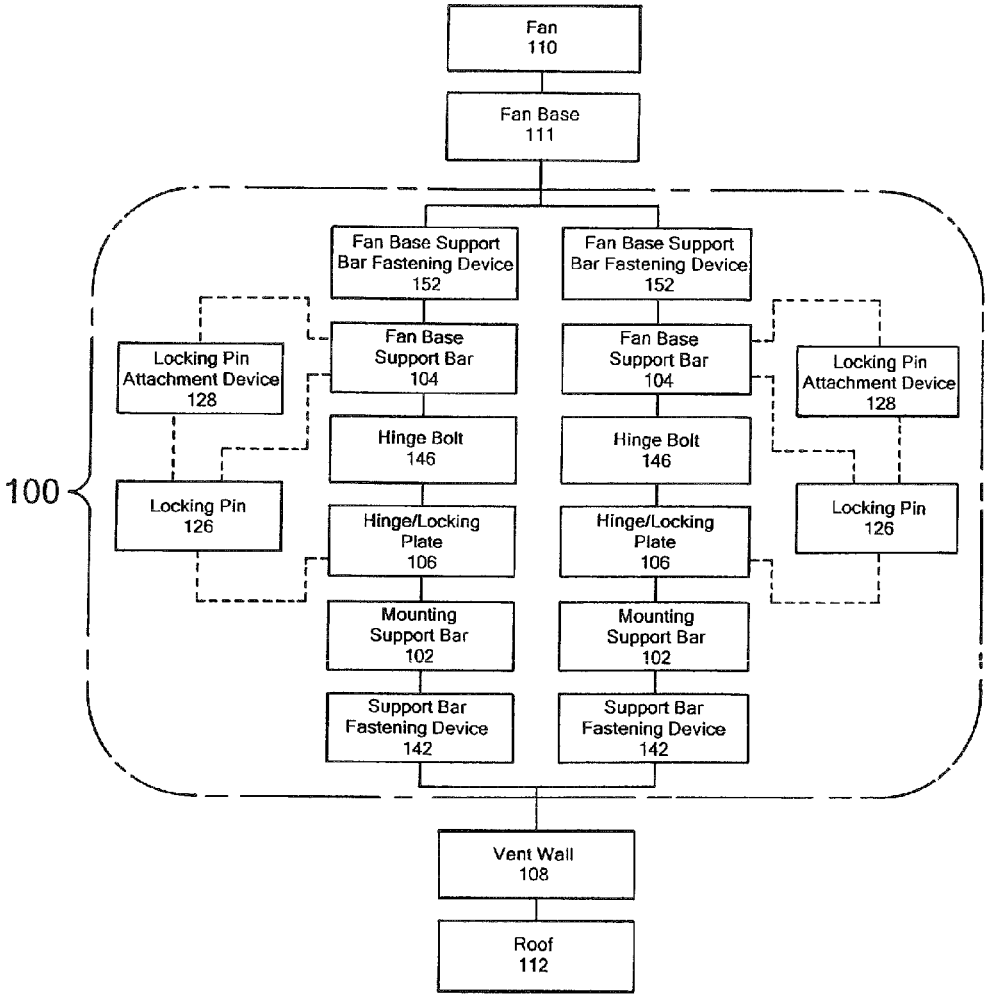
FIG. 14 depicts a block diagram of buttressed hinge assembly 100 of this invention, depicting a variety of hinge structures permitting an efficient use thereof.
Figure 15:
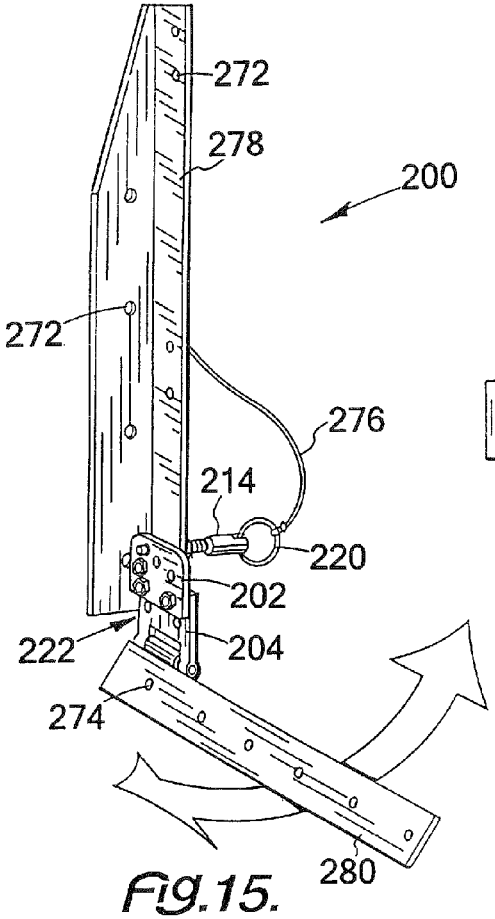
FIG. 15 depicts a perspective view of flexible hinge assembly 200 of this invention showing the swing adjustment functionality of mounting support bar 102.

With FIG. 14, a multitude of variations may be seen for buttressed hinge assembly 100 as set forth in previous figures. Mounting support bar 102 and fan support bar 104, combine with appropriate mounting devices or fasteners, so that fan 110 may be secured to roof 112 in a suitable fashion, which in turn permits fan 110 to provide the desired exhaust, while buttressed hinge assembly 100 permits support, movement and cleaning of fan 110 and vent wall 108. Inherently, the vent formed by vent wall 108 can also be cleaned.

As shown in FIG. 14, a series of mounting bar securing apertures 140 permit flexibility in attaching fan 110. Mounting bar securing apertures 140 are designed to cooperate with fastening device 142; which can be used in place of hinge bolt 162, plate bolt 164, hinge nut 166, and plate nut 168; to secure mounting support bar 102 to duct wall 108 in a secure and stable manner as in FIG. 9. Mounting bar securing apertures 140 cross a majority of the length of mounting support bar 102 so that stress from the weight of the fan 110 is not concentrated in one area. This increases the life and efficiency of buttressed hinge assembly 100.

Now adding FIG. 15, FIG. 16, FIG. 17, FIG. 18, and FIG. 19 to the consideration, flexible hinge assembly 200 can be clearly seen. In this embodiment, hinged mounting support bar 280 and angled fan support bar 278 attach as previously described in the earlier embodiment. Hinged mounting support bar 280 has mounting support bar attachment apertures 274 which cooperate with attachment fasteners to attach the hinged mounting support bar 280 to the vent wall 108. While angled fan support bar 278 has fan support bar attachment apertures 272 which cooperate with attachment fasteners to attach the angled fan support bar 278 to the fan base 111. Angled fan support bar 278 is angled at the upper end to accommodate the radius of the fan 110. Hinged mounting support bar 280 has the hinging flexibility seen in FIG. 15. Fan base 111 can have a wide range of sizes, shapes, and widths which can make it quite challenging to attach quick mount hinge 300, or any of the other embodiment present in this application. This flexibility accommodates a wide range of fan to duct combinations.

Hinge 222 is attached between angled fan support bar 278 and hinged mounting support bar 280. Hinge 222 has a hinged locking plate 202 and hinge plate 204. Angled fan support bar 278 has securing aperture 228 which cooperates with securing bolt 224, securing nut 226, and hinged locking plate aperture 230 to securely connect angled fan support bar 278 to hinged locking plate 202. Hinged locking plate 202 has threaded locking plate apertures 206 while hinge plate 204 has hinge plate apertures 208.

Hinged locking plate 202 serves as a cam locking plate. Hinge plate 204 has a series of attachment apertures 240 which cooperate and align with hinged locking plate apertures 230 and attachment fasteners 242 to secure hinged locking plate 202 to hinge plate 204. The two component system of hinged locking plate 202 and hinge plate 204 provides even greater flexibility for height adjustment to accommodate a variety of fan to duct combinations. The series of attachment apertures 240 provides the height adjustment.

On hinged mounting support bar 280 is pin collar 210. Pin collar 210 cooperates and aligns with hinge plate 204. Hinge pin 212 inserts through collar apertures 286 and hinge plate apertures 208 to secure hinged mounting support bar 280 to the hinge plate 204 in a pivotal relationship. This pivotal relationship provides great flexibility to accommodate a variety of fan to duct combinations.

On angled fan support bar 278 is threaded fan support bar aperture 216. Threaded fan support bar aperture 216 aligns and cooperates with threaded locking plate apertures 206, spring loaded threaded locking pin 214, and threaded locking pin nuts 218 to secure the fan support bar to the hinged locking plate 202 in a secure but releaseable relationship. This cooperative relationship allows fan base 111 to be secured in partially open position 254, fully open position 256, locking position 252, or closed position 260 and provides great efficiency in the cleaning and service process of the fan to which it is mounted. Spring loaded threaded locking pin 214 has an optional tether 276 which securely attaches it to the flexible hinge assembly 200.

Spring loaded threaded locking pin 214 has a release ring 220 which is spring loaded. Release ring 220 allows a user to pull the release ring outward and release the connection between the angled fan support bar 278 and the hinged locking plate 202 in a safe and efficient manner. The release of threaded locking pin 214 allows the fan base 111 to cover and protected vent wall 108.

Figure 16:
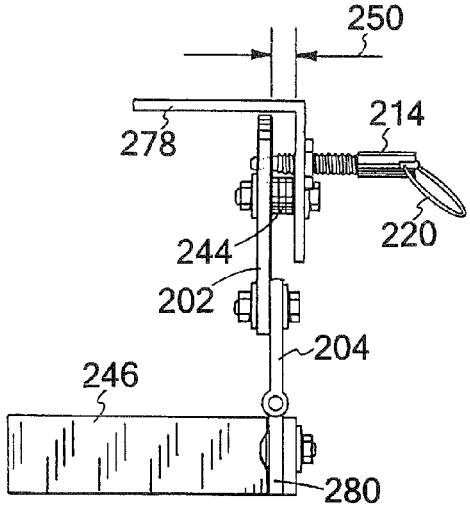
FIG. 16 depicts a front plan view of flexible hinge assembly 200 in narrow width adjustment 250.
Figure 17:
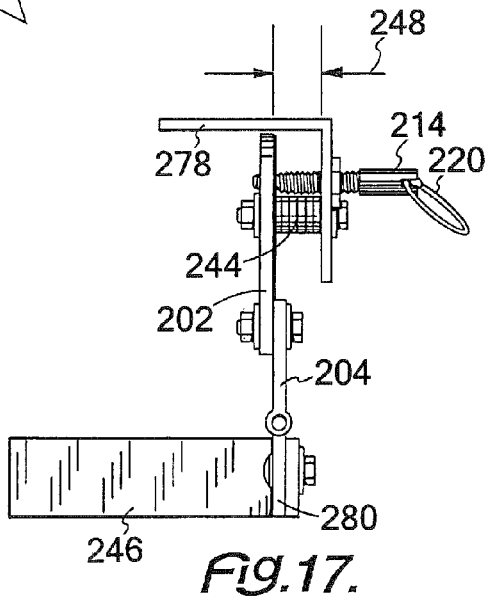
FIG. 17 shows a front plan view of flexible hinge assembly 200 in wide width adjustment 248.
Figure 18:
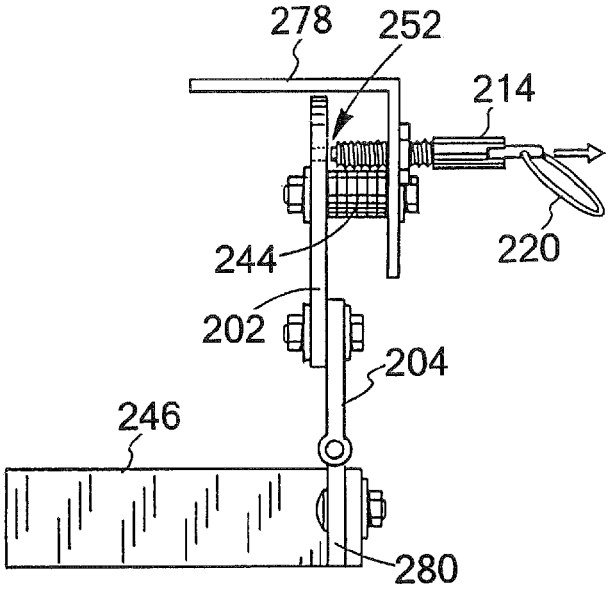
FIG. 18 shows a front plan view of flexible hinge assembly 200 with spring loaded threaded locking pin 214 withdrawing from locking position 252.
Figure 19:
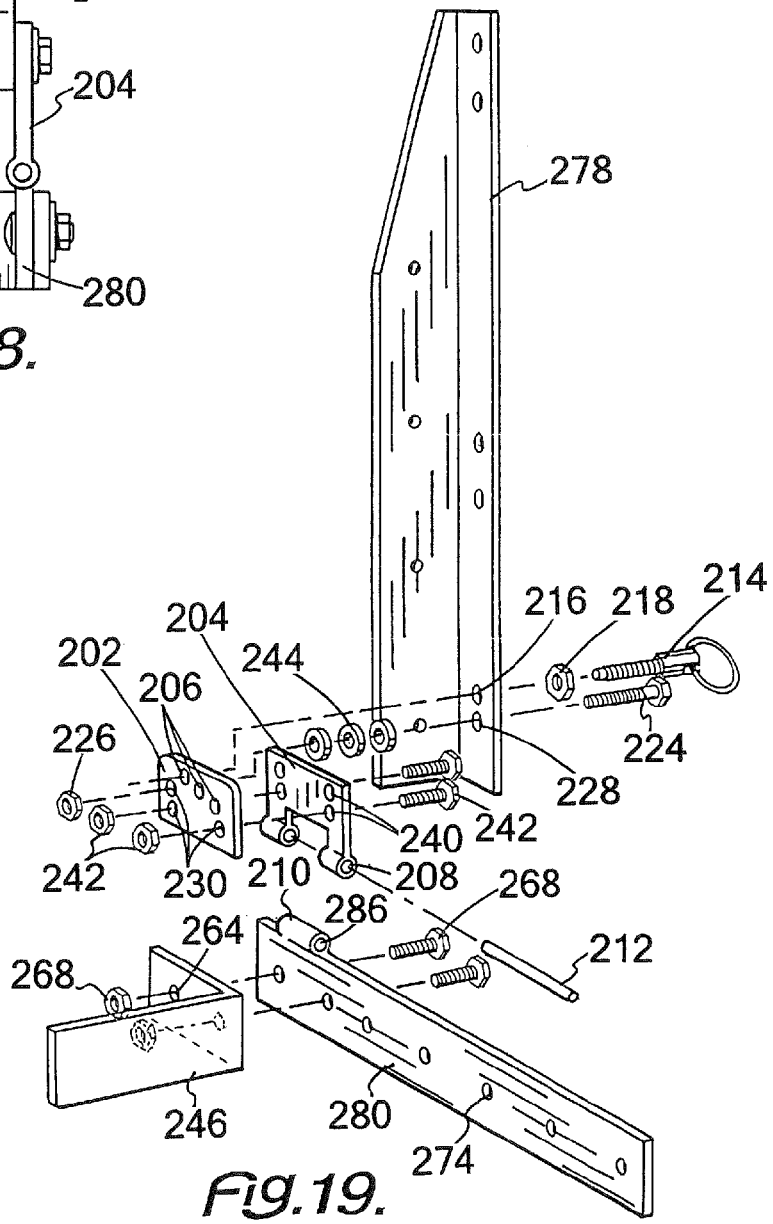
FIG. 19 depicts an exploded perspective view of flexible hinge assembly 200 of this invention.

Referring specifically to FIG. 16, FIG. 17, and FIG. 18, the function of adjustment shims 244 can be clearly seen. Between angled fan support bar 278 and hinged locking plate 202 is a series of adjustment shims 244 which are preferably made of nylon but any other suitable material can be used. Adjustment shims 244 can be added or removed to increase or decrease the space between angled fan support bar 104 and hinged locking plate 202. Adjustment shims 244 provide greater flexibility and allow for wider or narrower fan to duct combinations. If fan base 111 is wider than duct 108, more adjustment shim 244 will be needed to fill the increased space and accommodate this combination. If fan base 111, is not significantly wider than duct 108, then fewer adjustment shims 244 will be needed to accommodate this situation.

Spring loaded threaded locking pin 214 has to be adjusted as the number of adjustment shims 244 are adjusted. In FIG. 16, when fewer adjustment shims 244 are used, spring loaded threaded locking pin 214 does not have to be screwed further into threaded locking plate aperture 206 and threaded fan support bar aperture 216. In contrast, when more adjustment shims 244 are used, spring loaded threaded locking pin 214 has to be screwed further into threaded apertures 206 and 216 to accommodate the added distance. Spring loaded threaded locking pin 214 is secured into position by threaded locking pin nut 218.

Referring specifically to FIG. 18, spring loaded locking pin 218 is withdrawing from locking position 252. Once the spring loaded locking pin 218 is withdrawn, the angled fan support bar 278 can be moved into another position and secured again by spring loaded locking pin 218.

Figure 20:
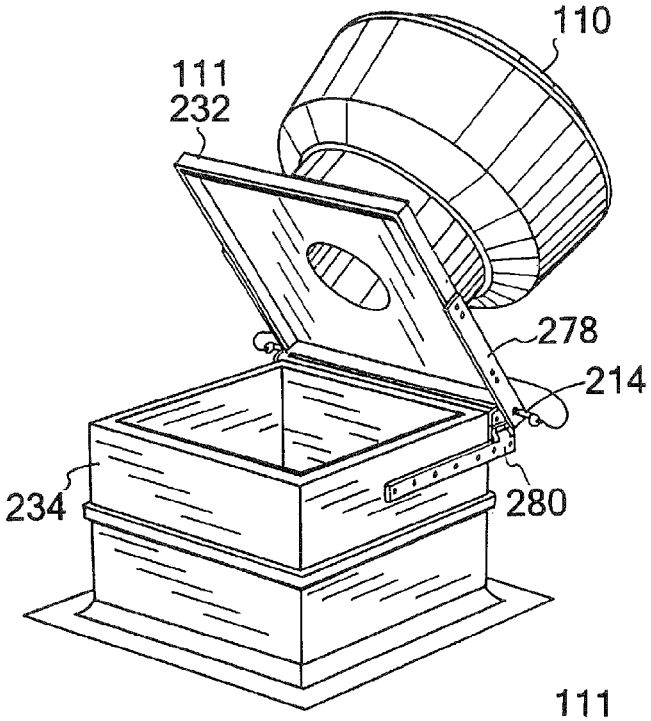
FIG. 20 depicts a frontal perspective view of flexible hinge assembly 200 installed on square vent wall 234.
Figure 21:
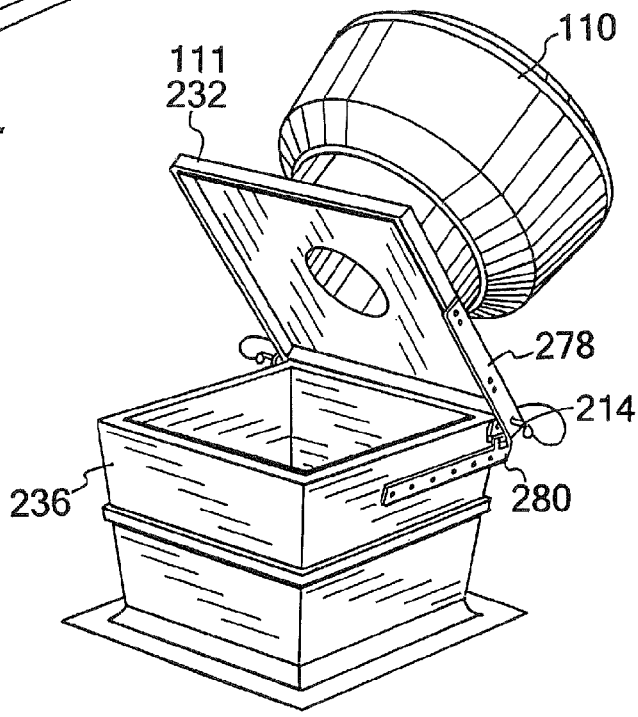
FIG. 21 depicts a frontal perspective view of flexible hinge assembly 200 installed on tapered vent wall 236.
Figure 22:
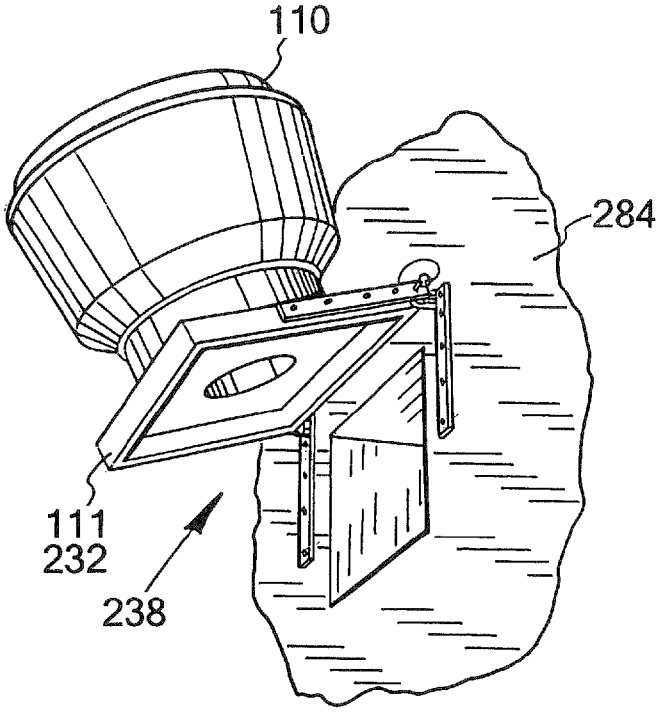
FIG. 22 depicts a frontal perspective view of flexible hinge assembly 200 accommodating wall mount configuration 238.

Now adding FIG. 20, FIG. 21, and FIG. 22 to the consideration, the advantages of hinge 222, hinged locking plate 202, hinge plate 204 and hinged mounting support bar 280 can be clearly seen. In the industry, there are a variety of fan to duct combinations. In FIG. 20, square fan base 232 fits substantially squarely on square vent wall 234. In these combinations, hinge 222 remains substantially vertical and little angular movement of hinged mounting support bar 280 is required.

However in FIG. 21, square fan base 232 is broader than tapered vent wall 236. In this fan to duct combination, hinge 222 allows hinged mounting support bar 280 to angle inward to obtain a secure connection between the square fan base 232 and tapered vent wall 236.

In FIG. 22, wall mount configuration 238 can be clearly seen. In wall mount configuration 238, hinged mounting support bar 280 moves 90 degrees and rests on the top of vent wall 108. Wall mount configuration 238 helps to accommodate a wide variety of wall mounted ducts 108.

Figure 23:
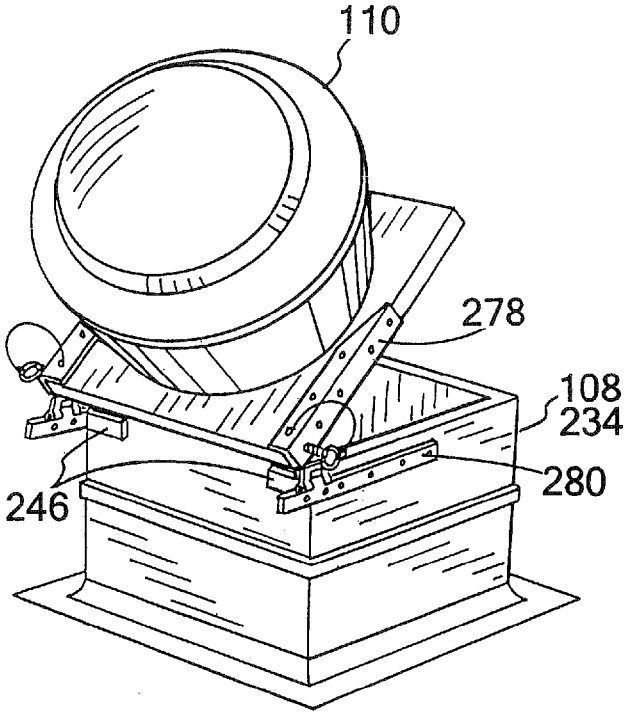
FIG. 23 depicts a rear perspective view of flexible hinge assembly 200 installed on square vent wall 334 with support brace 246 reinforcement.

Adding FIG. 23 to the consideration, an optional feature of flexible hinge assembly 200 can be clearly seen. Support brace 246 aids in supporting hinged mounting bar 280 and hinged locking plate 202 when fan 110 is in partially open position 254 or fully open position 256. Support brace 246 acts as a stabilizing component when dealing with the weight of fan 110.

Support brace 246 has support brace apertures 264 while hinged mounting support bar 280 has mounting support bar attachment apertures 274. Apertures 264 and 274 cooperate with support brace fasteners 268 to securely attach support brace 246 to hinged mounting support bar 280. In this embodiment, nuts bolts are used as support brace fasteners 268. However, support brace fastener 268 can be any other suitable fastener which can securely fasten the support brace 246 to the hinged mounting support bar 280.

Also, the positioning of hinged locking plate 202 can be clearly seen in FIG. 23. Hinged locking plate 202 is positioned behind the fan 110, fan base 111, and vent wall 108. This positioning allows for the weight of the fan to be balanced behind the fan 110, fan base 111, and vent wall 108 but not on the vent wall 108. Due to the enormous weights of fan 108, this position helps to manage the weight, as fan 108 is moved.

Figure 24:
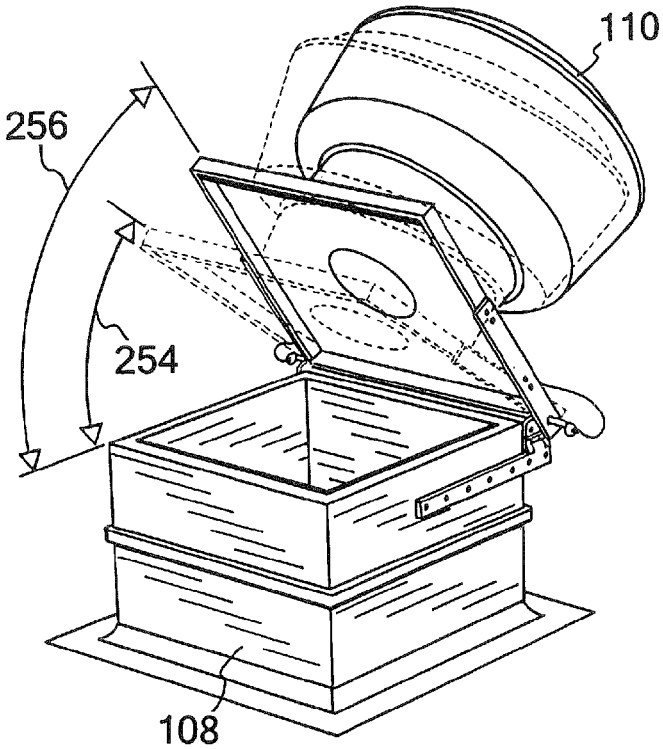
FIG. 24 depicts a frontal perspective view of flexible hinge assembly 200 with two open angles for easy maintenance.
Figure 25:
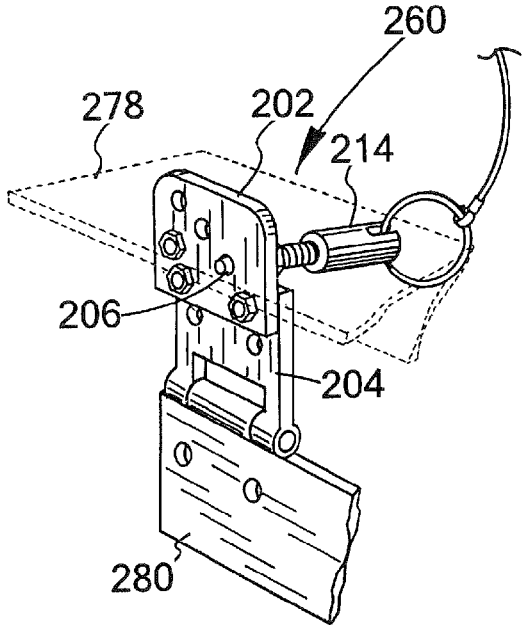
FIG. 25 depicts a front perspective view of flexible hinge assembly 200 in closed position 260.

Adding FIG. 24 and FIG. 25 to the consideration, the adjustability of flexible hinge assembly 200 can be clearly seen. Flexible hinge assembly 200 can adjust fan 110 to partially open position 254 and fully open position 256 in relation to vent wall 108. Finally, fan 110 can be placed in closed and locking position 252 and 260. Spring loaded threaded locking pin 214 can be placed in locking position 252 to further secure fan 110 in closed position 260. Closed and locked position 252 and 260 provides for great safety features from weather, changes in barometric pressure, wind, or other unforeseen conditions.

Now adding FIG. 26 through FIG. 41 to the consideration, further embodiments, the quick mount hinge 300 and quick mount hinge with pivot 600, can be clearly seen. Quick mount hinge 300 and quick mount hinge with pivot 600 are designed to be installed while the fan is still in use. As such, the restaurant or other business does not have to cease cooking or other restaurant or business activity so that quick mount hinge 300 or the quick mount hinge with pivot 600 may be properly installed. This results in a great savings in time and money for the restaurant or business.

As seen in previous embodiments, quick mount hinge 300 and quick mount hinge with pivot 600 have the pivot point and hingeable motion behind the fan 110. The ends of fan support bar 404, vent bar 410, and locking plates 556 are behind fan 510. This allows the fan base 111 to lift up, off and back of the vent wall 108 to prevent any binding from the overlap of the fan base 111 and the vent wall 108.

Figure 26:
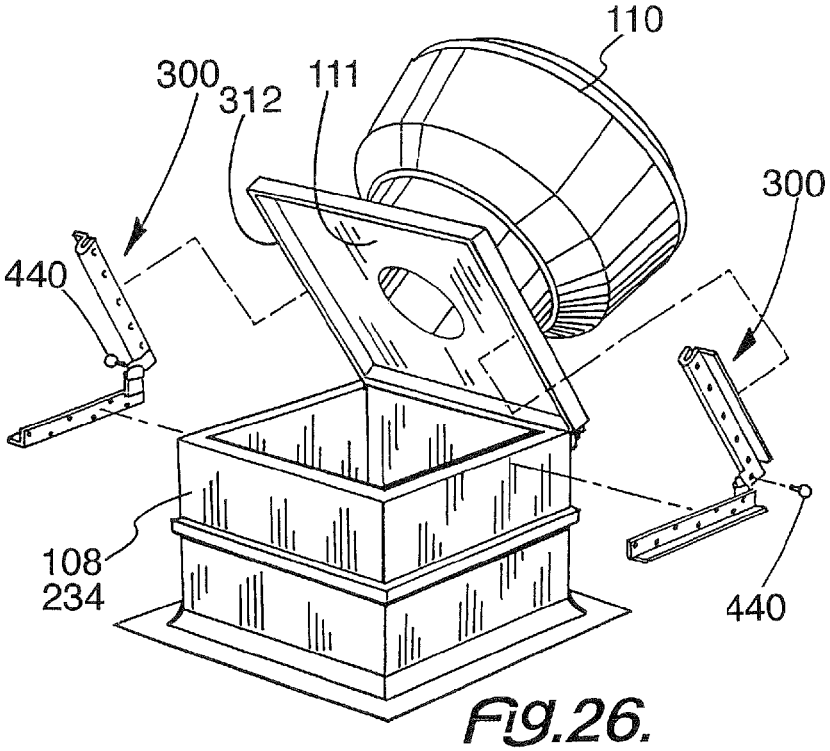
FIG. 26 depicts a front perspective view of fan 110 installed on vent wall 108 with quick mount hinge 300.
Figure 27:
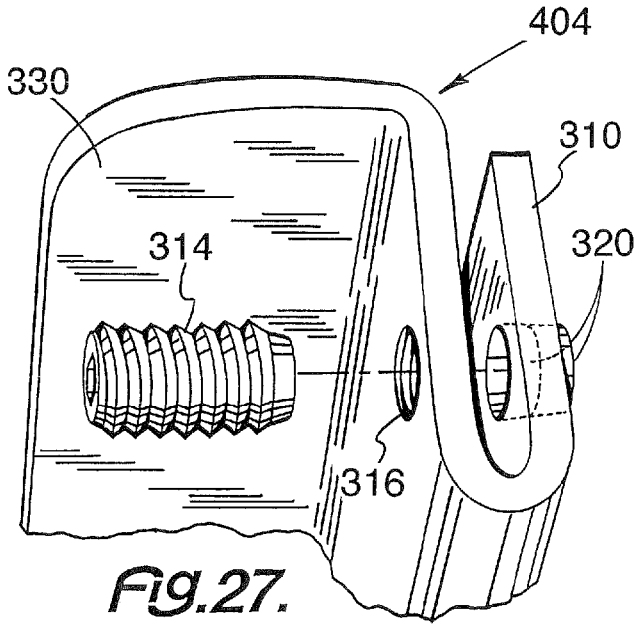
FIG. 27 depicts a front, bottom perspective view of set screw 314 cooperating with threaded aperture 316 and locking dimple 320.
Figure 28:
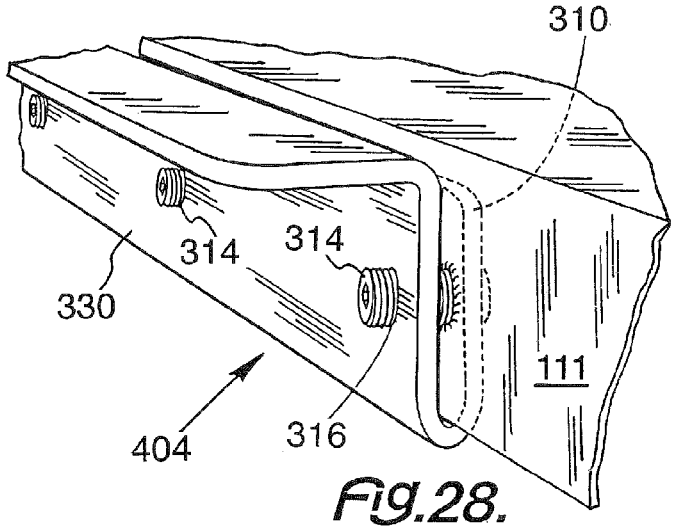
FIG. 28 depicts a front perspective view, partially in phantom, of fan support bar 404 affixed to fan base 111 with set screw 316 cooperating with locking dimple 320.

Specifically referring to FIG. 26 and FIG. 27, the structure of quick mount hinge 300 can be clearly seen. Quick mount hinge 300 is inserted between and hinges fan 110 and vent wall 108. Fan support bar 404 is secured to fan 110 through fan base 111 and mounting support bar 416 (See FIG. 35) is secured to vent wall 108. Fan base 111 has a lip 312 at its securing edge. Fan bar 404 is designed to saddle mount 310 the fan base 111 to aid in easy and quick installation. Fan support bar 404 has a U-shaped saddle mount 310 which cooperates with fan base 111 to form a secure and stable attachment. While in this embodiment a U-shaped saddle mount 310 is preferred, saddle mount 310 can be any suitable shape for securing the fan base 111 to fan support bar 404. Spring loaded locking pin 440 aids in positioning fan support bar 404 at a variety of angles relative to mounting support bar 416.

Now considering FIG. 27, FIG. 28, FIG. 29, FIG. 30, FIG. 31, FIG. 32, FIG. 33, and FIG. 34, the saddle mount 310 is more clearly depicted. Fan support bar 404 has a series of threaded apertures 316 which cooperate with set screw 314 to securely attach fan support bar 404 to fan base 111. An optional, but preferred, embodiment can be seen in FIG. 28. In this embodiment, fan support bar 404 has a locking dimple 320 which cooperates with set screw 314 to further push lip 312 of fan base 111 against fan support bar 404 thus increasing the stability of the attachment.

Figure 29:
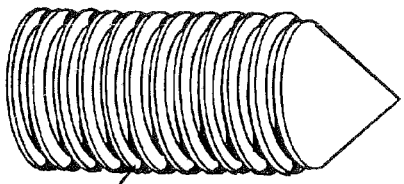
Fig.29. Prior Art
FIG. 29 depicts a front perspective view of set screw 314 which is depicted as cone point tip 340 in this embodiment.
Figure 30:
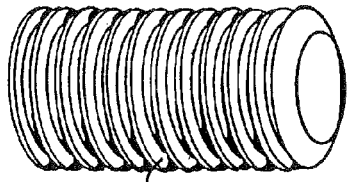
Fig.30. Prior Art
FIG. 30 depicts a front perspective view of set screw 314 which is depicted as flat tip 342 in this embodiment.
Figure 31:
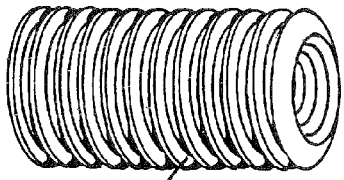
Fig.31. Prior Art
FIG. 31 depicts a front perspective view of set screw 314 which is depicted as cup tip 344 in this embodiment.
Figure 32:
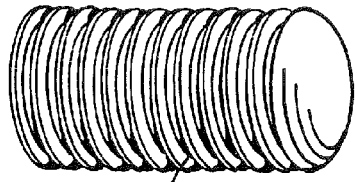
Fig.32. Prior Art
FIG. 32 depicts a front perspective view of set screw 314 which is depicted as oval tip 346 in this embodiment.
Figure 33:
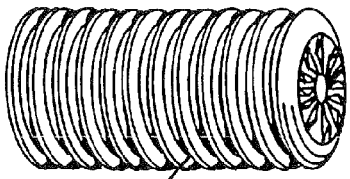
Fig.33. Prior Art
FIG. 33 depicts a front perspective view of set screw 314 which is depicted as knurl tip 348 in this embodiment.
Figure 34:
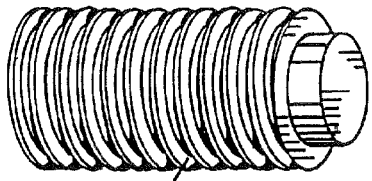
Fig.34. Prior Art
FIG. 34 depicts a front perspective view of set screw 314 which is depicted as half dog tip 350 in this embodiment.

Set screw 314 can be any suitable attachment mechanism capable of forming a secure and stable relationship in saddle mount 310. However, a few exemplary embodiments are provided. FIG. 29 depicts cone point tip 340, FIG. 30 depicts flat tip 342, FIG. 31 depicts cup tip 344, FIG. 32 depicts oval tip 346, FIG. 33 depicts knurl tip 348, and FIG. 34 depicts half dog tip 350. These examples are not intended to limit the scope of set screws 314 but provide examples as to suitable methods.

Figure 35:
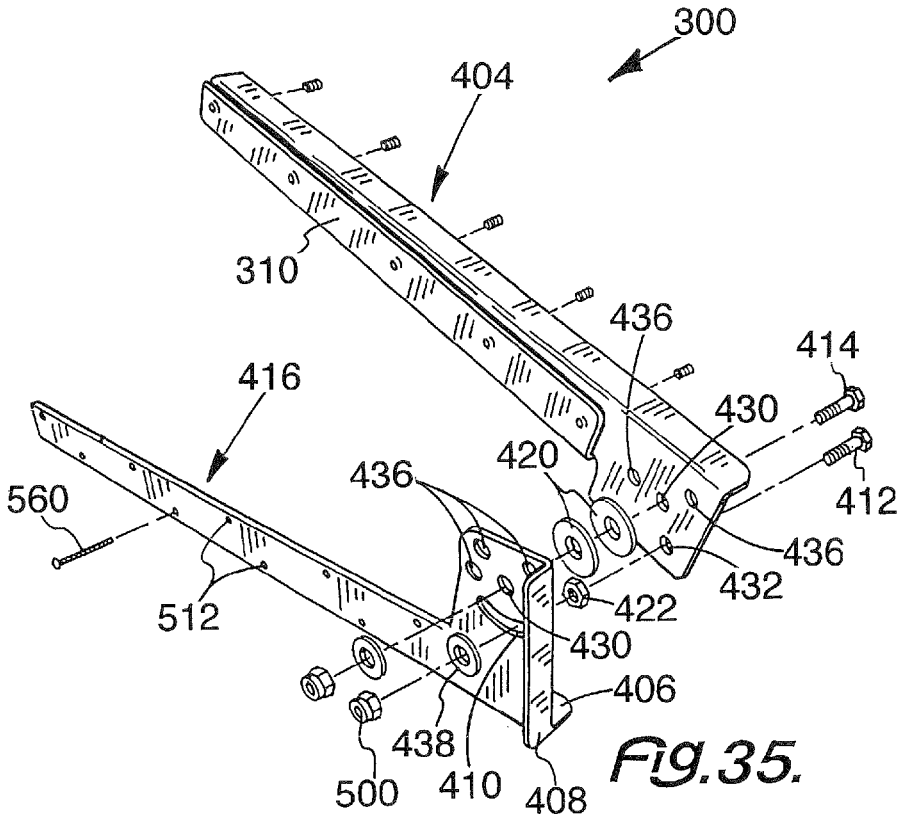
FIG. 35 depicts an exploded perspective view of the outside angle of quick mount hinge 300.
Figure 36:
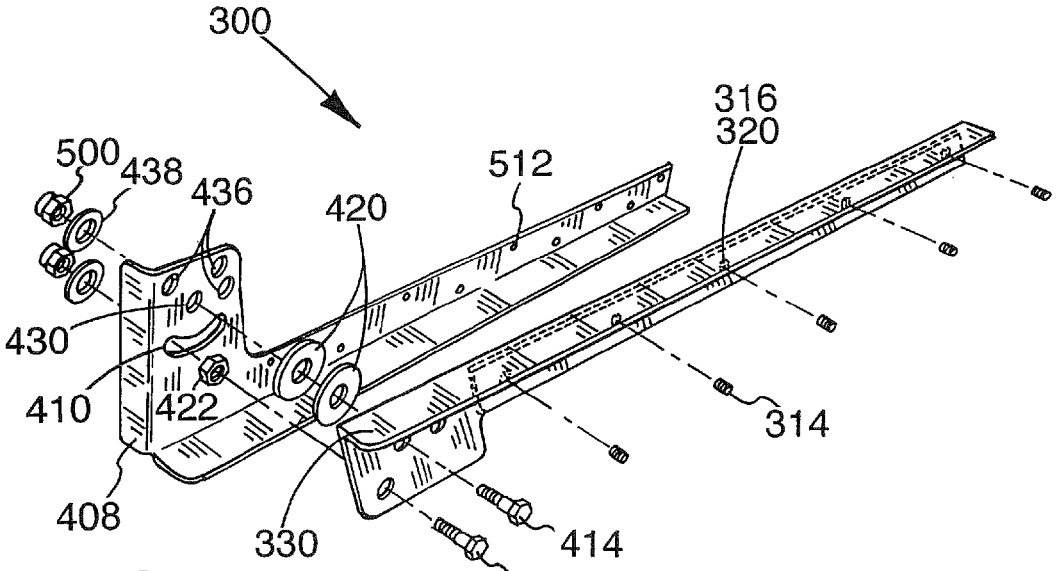
FIG. 36 depicts an exploded perspective view of the inside angle of quick mount hinge 300.

Referring to FIG. 35 and FIG. 36, the structure of quick mount hinge 300 can be more clearly seen. The flexibility of quick mount hinge 300 is also depicted.

Fan support bar 404 and mounting support bar 416 connect to form a movable relationship. Fan support bar 404 has a series of set screws 314 and threaded apertures 316 to secure it to fan base 111 of fan 110. The staggered positioning of threaded apertures 316 adds to the strength and stability of the grip of set screws 314 into fan base 111. Mounting support bar 416 is mounted to vent 108 through either one or a plurality of lower bar fasteners 560. Fan support bar 404 also has hinge aperture 430 which cooperates with hinge bolt 414, adjustment shims 420, fastener washer 438, and fastener nut 500 to form a secure and stable relationship. Fan support bar 404 also has first stiffener strut 330 which helps add support and prevents fan support bar 404 and the entire quick mount hinge 300 from flexing due to the weight of the fan 110. Fan support bar 404 has saddle mount 310 which cooperates with lip 312 on fan base 111.

Adjustment shims 420 can be as few or as many as needed to accommodate different fan base 111 and vent wall 108 combinations. For narrower vent walls 108 than fan bases 111 more adjustment shims 420 are necessary and fewer adjustment shims 420 are needed the wider the vent wall becomes.

Figure 37:
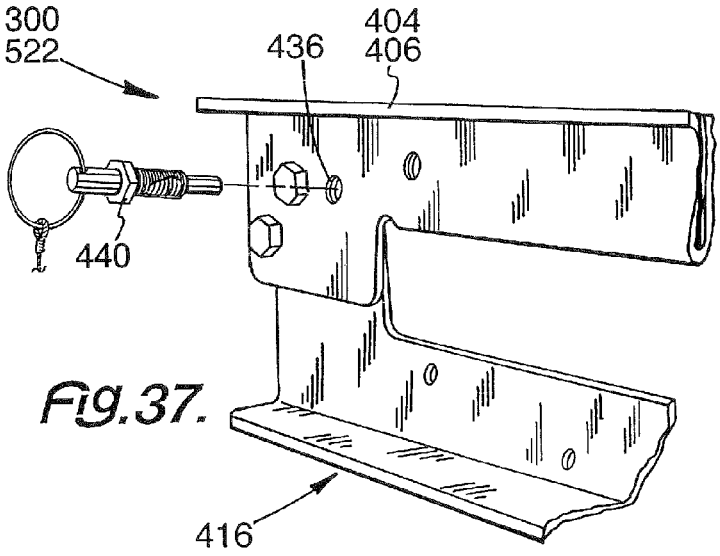
FIG. 37 depicts a side perspective view of quick mount hinge 300 locked in closed position 522 and a cut away view of spring loaded locking pin 440 cooperating with threaded pin aperture 436.
Figure 38:
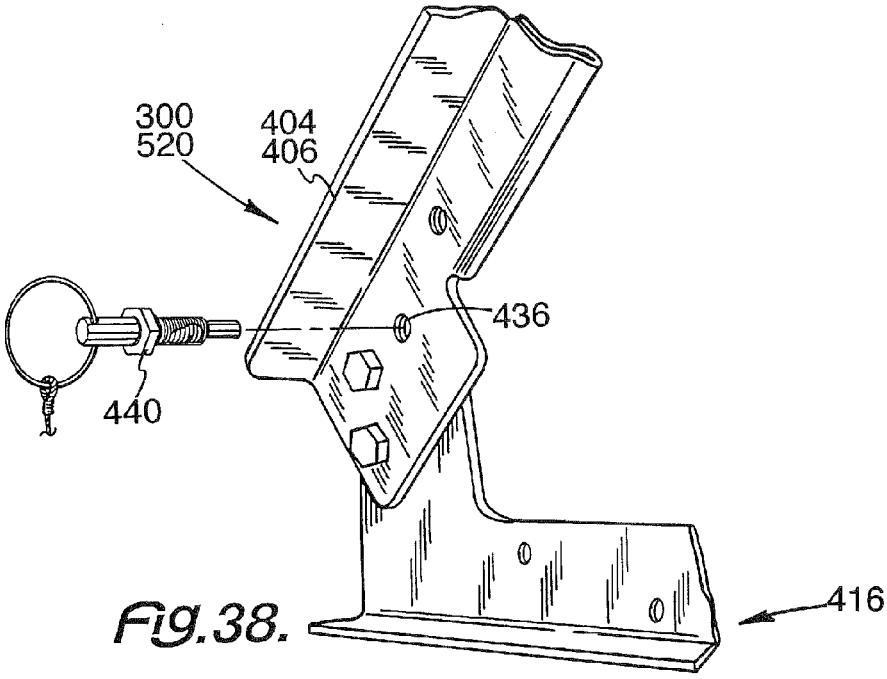
FIG. 38 depicts a side, perspective view of quick mount hinge 300 locked in open position 520 and spring loaded locking pin 440 cooperating with pin apertures 436.
Figure 39:
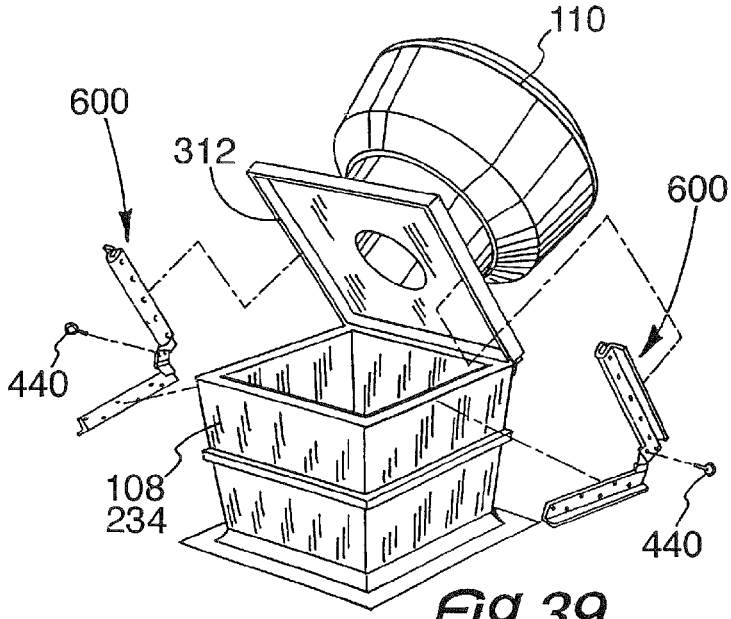
FIG. 39 depicts an exploded, front perspective view of fan 110 installed on tapered vent wall 236 with quick mount hinge with pivot 600.

Fan support bar 404 also has a series of threaded pin apertures 436 which align with threaded pin apertures 436 on mounting support bar 416 and accept spring loaded locking pin 440 (as seen in FIG. 37 and FIG. 38). This series of threaded pin apertures 436 allows fan base 111 to be positioned at different angles relative to vent wall 108 (as depicted in FIG. 38 and FIG. 39). Mounting support bar 416 has travel slot 410 and fan support bar 404 has travel bolt aperture 432. Travel slot 410 and travel bolt aperture 432 align and cooperate with travel bolt 412, lock nut 422, fastener washer 438 and fastener nut 500 to form a secure yet pivotable relationship. Travel slot 410 permits quick mount hinge 300 to move fan 110 with fan base 111 at various angles relative to vent wall 108 and these angles are secured with spring loaded locking pin 440.

Mounting support bar 416 has a series of top mount apertures 512 which cooperate with top mount aperture screws 560 to securely attach mounting support bar 416 to vent wall 108. Mounting support bar 416 has second stiffener strut 406 and third stiffener strut 408 which help add support and prevent fan support bar 404 and the entire quick mount hinge 300 from flexing due to the weight of the fan 110. Mounting support bar 416 also has hinge aperture 430 which cooperates with adjustment shims 420, the hinge aperture 430 on fan support bar 404, fastener washer 438, and fastener nut 500 to form a secure attachment. Mounting support bar 416 also has a travel bolt slot 410 which cooperates with travel bolt 412, travel aperture 432, lock nut 422, fastener washer 438, and fastener nut 500 to allow fan 110 with fan base 111 to travel and be placed in various angles relative to vent wall 108. Finally, mounting support bar 416 has threaded pin apertures 436 which cooperate with spring loaded locking pin 440 and threaded pin apertures 436 on fan support bar 404 to allow the fan 110 with fan base 111 to be securely placed and held in angles relative to vent wall 108 (as depicted in FIG. 37 and FIG. 38).

Spring loaded locking pin 440 can be any suitable pin for forming the secure relationship mounting support bar 416 and fan support bar 404. However, the preferred embodiment is a spring loaded locking pin 440.

Now adding FIG. 37 and FIG. 38 to the consideration, the use of spring loaded locking pin 440 is utilized in this embodiment. Fan support bar 404 and mounting support bar 416 each have a threaded pin aperture 436 which align to accept spring loaded locking pin 440. FIG. 37 depicts spring loaded locking pin 440 securely holding the combination in swing lock closed position 522. FIG. 38 depicts spring loaded locking pin 440 securely holding the combination in swing lock open position 520. Spring loaded locking pin 440 allows fan support bar 404 to be held in a variety of positions or angles relative to mounting support bar 416 which facilitates cleaning and maintenance. The examples depicted in FIG. 37 and FIG. 38 are intended to demonstrate possible positions and not limit the scope to only these illustrations.

Figure 40:
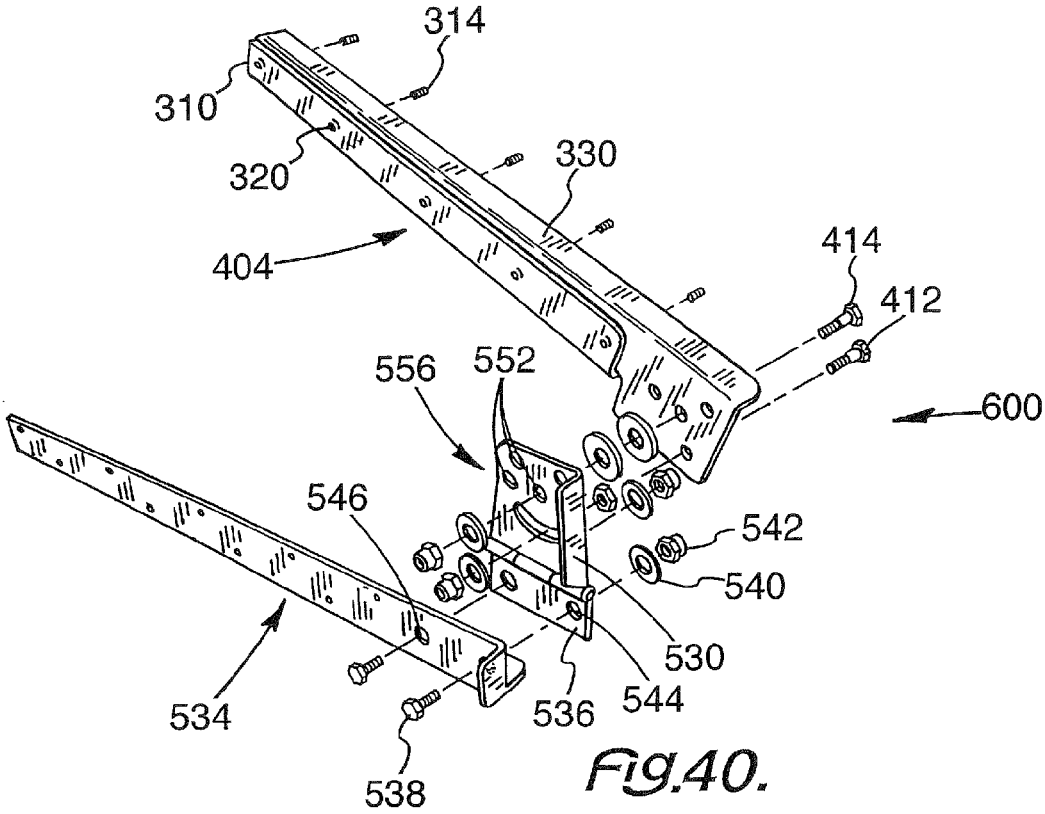
FIG. 40 depicts an exploded perspective view of the inside angle of quick mount hinge with pivot 600.
Figure 41:
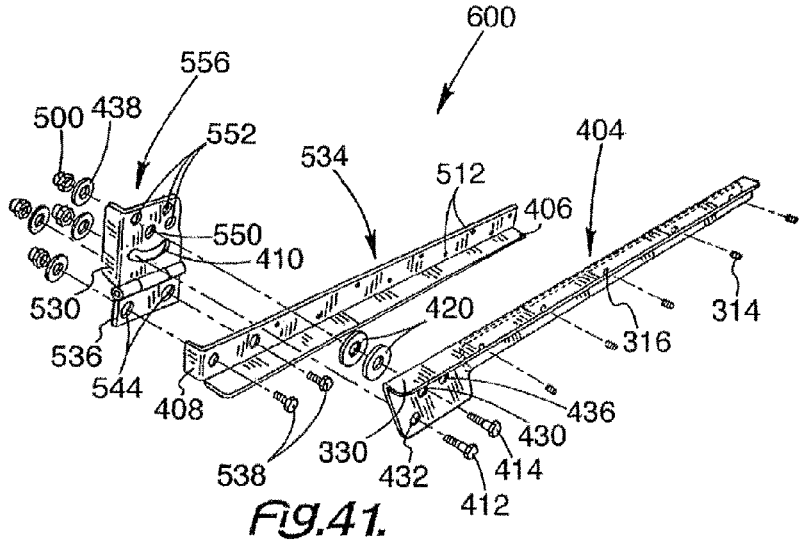
FIG. 41 depicts an exploded perspective view of the outside angle of quick mount hinge with pivot 600.

Now referring specifically to FIG. 39, FIG. 40, and FIG. 41, quick mount hinge with pivot 600 can be clearly seen. Quick mount hinge with pivot 600 has fan support bar 404 and vent bar 534. Fan support bar 404 has saddle mount 310 which attaches to fan base 111 at lip 312. Fan support bar 404 is held in a variety of angles relative to vent wall 108 and secured in place with spring loaded locking pin 440.

Fan support bar 404 attaches to fan base 111 through the cooperation of threaded apertures 316, set screws 314 (as depicted in FIGS. 29 through 34), and the optional locking dimples 320. Locking dimples 320 aid in securing the connection between the set screws 314 and fan base 111 to provide further strength and support. Fan support bar 404 has first stiffener strut 330 which helps add support and prevents fan support bar 404 and the entire quick mount hinge with pivot 600 from flexing due to the weight of the fan 110.

Vent bar 534 attaches to vent wall 108 through a series of top mount apertures 512. Vent bar 534 has second stiffener strut 406 and third stiffener strut 408 which adds to the support and stability to entire quick mount hinge with pivot 600 from flexing due to the weight of the fan 110. Top mount apertures 512 are staggered which helps support and balance the weight of fan 110 over the entire length of vent bar 534. Vent bar 534 has bar apertures 546.

Swing hinge bracket 556 inserts between vent bar 534 and fan support bar 404 to form the hinge relationship. Swing hinge bracket 556 has a hinge flange 536 which attaches in a hingeable relationship. Swing hinge bracket 556 allows greater flexibility for different fan 110 with fan base 111 to vent wall 108 combinations and can accommodate for tapered, irregular, or straight combinations (See FIG. 21 through FIG. 24). Swing hinge bracket has mount stiffener strut 530 which helps the entire quick mount hinge with pivot 600 from flexing due to the weight of the fan 110. Hinge flange 536 has flange apertures 544. Flange apertures 544 cooperate with bar apertures 546, flange screw 538, flange washer 540, and flange nut 542 to secure hinge flange 536 to vent bar 534.

Fan support bar 404 has travel bolt aperture 432 which cooperates with travel slot 410 on swing hinge bracket 556. Travel bolt 412 inserts through travel bolt aperture 432 and travel slot 410 and is secured in a movable relationship with fastener washer 438 and fastener nut 500.

Fan support bar 404 also has hinge aperture 430 which cooperates with hinge bolt 414, adjustment shims 420, fastener washer 438, fastener nut 500, and mount hinge aperture 550 to secure fan support bar 404 to swing hinge bracket 556. Finally, fan support bar 404 has threaded pin aperture 436 which cooperates with lock pin receiving apertures 552 on swing hinge bracket 556. This alignment accepts spring loaded locking pin 440 to secure the fan support bar 404 in various angle relative to vent bar 534.

Now adding FIG. 42, FIG. 43, FIG. 44, FIG. 45, and FIG. 46 to the consideration, the structure of quick mount hinge with tabs 700 can be clearly seen. The quick mount hinge with tabs 700 greatly simplifies the installation process and requires a single worker instead of multiple ones. The structure of quick mount hinge with tabs 700 is specially designed to support the weight of fan 110.

Figure 44:
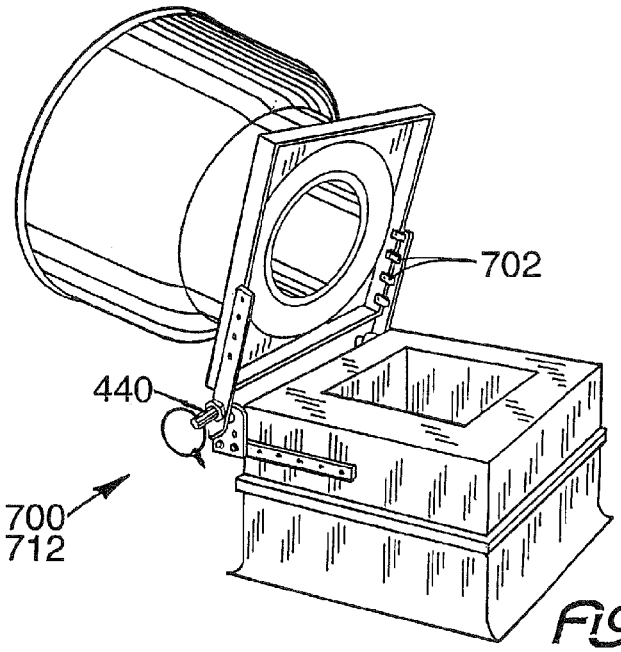
FIG. 44 depicts a front perspective view of quick mount hinge with tabs 700 in open position 712.

Quick mount hinge with tabs 700 has fan support bar or also referred to as the fan base support bar 704 and mounting support bar or also referred to as the surface support bar 710. Fasteners 720 which may or may not be set screws 314, cooperate with threaded apertures 722 and dimples 718 to secure fan base support bar 704 to fan base 111. Dimples 718 are an optional, but preferred feature to further strengthen the connection between fan base support bar 704 and fan base 111. Furthermore, fasteners 720 can also be bolts or any other suitable fastener that can form a secure and stable relationship between fan base support bar 704 and fan base 111. The fan base support bar 704 includes a fan base mounting section 7042 and a fan base support arm 7044 that extends from the fan base mounting section 7402 and which includes the at least one tab 700 that extend upwardly and outwardly from a lower portion 7048 of the fan base support arm 7044 to create a channel 7046 between the at least one tab 700 and the fan base support arm 7044. The cannel being configured to permit a portion of the fan base to be secured easily and properly therein (FIG. 44.)

Mounting support bar or the surface support bar 710 is secured to vent wall 108 or another surface through its cooperation with fasteners 720 and apertures 724. Fasteners 720 may be threaded or unthreaded screws, bolts, or any other suitable fastener to form a secure and stable relationship between mounting support bar 710 and vent wall 108 or other surface. The surface support bar 710 includes a surface support arm 7104 which extends from a surface support mounting section 7102. As noted herein the surface support arm 7104 includes apertures that aid in securing the surface support bar 710 to a surface or vent wall.

Locking plate or hinge plate 708 is positioned to allow fan support bar 104 and mounting support bar 710 to form a hingeable relationship. The locking plate or hinge plate 708 includes hinge plate openings 7082 and hinge support openings 7084. The hinge plate opening 7082 are used in conjunction with fasteners to secure the hinge plate 708 to the fan base support bar 704, while hinge support openings 7084 are used with fasteners to secure the hinge plate 708 to the surface support bar 710. Fasteners 720 cooperate with locking plate apertures 726, threaded apertures 722 on both fan support bar 704 and mounting support bar 710, to configure quick mount hinge with tabs 700. Spring loaded locking pin 440 cooperates with locking pin apertures 726 to position the fan support bar 704 in different angles relative to mounting support bar 710 (See also, FIG. 1 through FIG. 40). Spring loaded locking pin 440 is preferably spring loaded, however any suitable locking pin may be utilized as long as it forms a secure yet releaseable relationship between locking plate or hinge plate 708 and fan base support bar 704.

As seen and described in previous embodiments, quick mount hinge with tabs 700 has optional adjustment shims 730. Adjustment shims 730 add to the flexibility of quick mount hinge with tabs 700 to accommodate varying fan base 111 to vent wall 108 combinations (See also, FIG. 20 through FIG. 24). While adjustment shims 730 are not required, they are preferred, to provide greater flexibility of quick mount hinge with tabs 700. Adjustment shims 730 can be added or removed to increase or decrease the space between fan base support bar 704 and locking plate or hinge plate 708. If fan base 111 is wider than vent wall 108, more adjustment shim 730 will be needed to fill the increased space and accommodate this combination. If fan base 111, is not significantly wider than vent wall 108, then fewer adjustment shims 730 will be needed to accommodate this situation.

In this embodiment, tabs 702 replace saddle mount 310 and are offset so there is a space between the tabs 702 and fan base support bar 704 to accommodate fan base 111. Again, in this embodiment, the hinge 700 can be installed while the restaurant, business, or other establishment is still in operation, thereby saving the consumer time and money.

Figure 42:
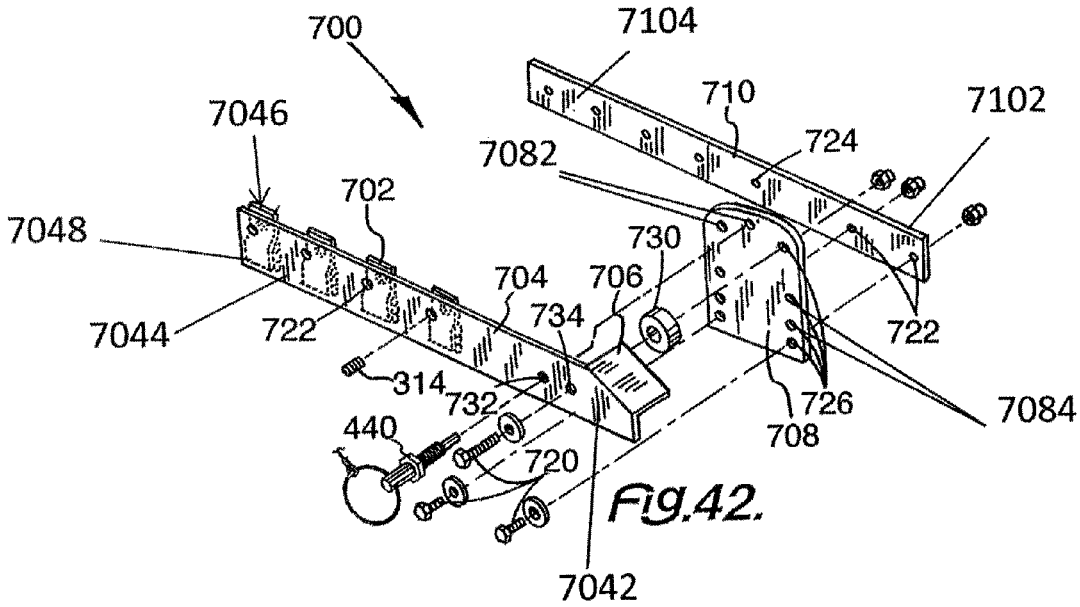
FIG. 42 depicts an exploded perspective view of quick mount hinge with tabs 700.
Figure 45:
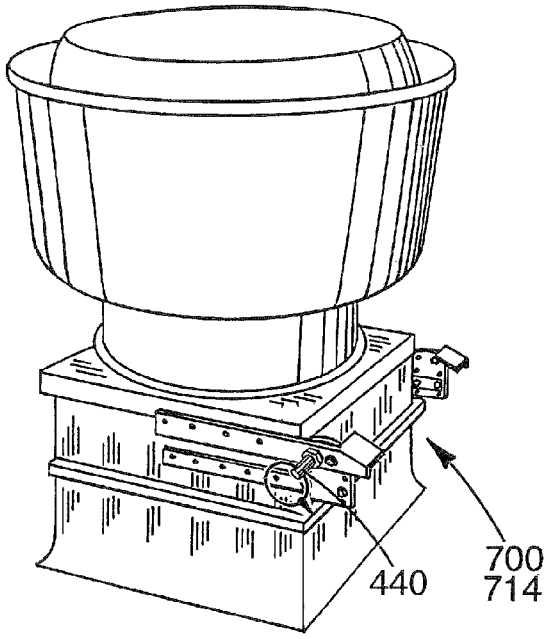
FIG. 45 depicts a rear perspective view of quick mount hinge with tabs 700 in lockdown position 714.
Figure 46:
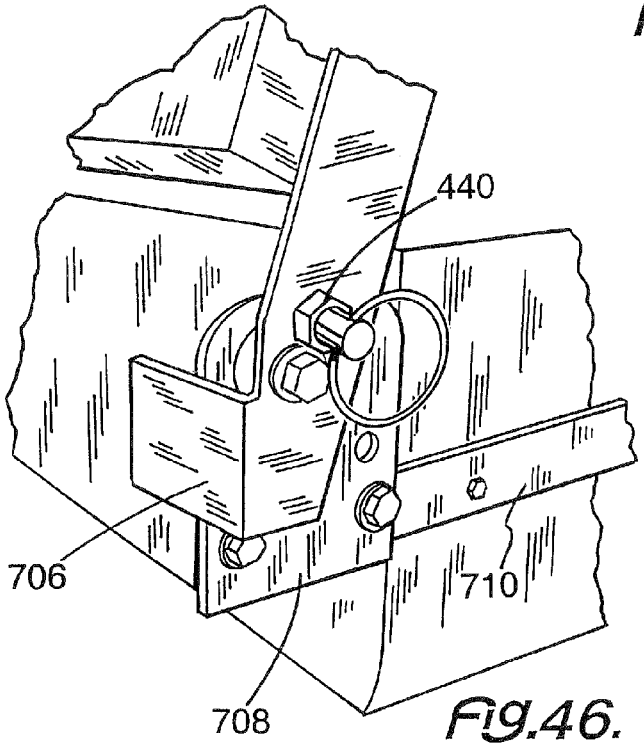
FIG. 46 depicts a rear perspective view featuring a close up of fan rest 706 resting against locking plate 708.

Referring specifically to FIG. 42, FIG. 45, and FIG. 46 the function and structure of fan rest 706 can be clearly seen. When fan base 111 is lifted for cleaning or other purposes, fan rest 706 prevents fan base 111 and fan 110 from tipping too far behind the hinge. This is a great advantage because due to the weight of fan 110, if the fan base 111 tips too far backwards, it can be difficult, if not impossible, to lift without the help of machinery. Also, as seen in FIG. 46, fan rest 706 abuts locking plate or hinge plate 708. The locking plate or hinge plate 708 helps to handle the weight of fan 110 and relieves some of the pressure on fan rest 706.

Figure 43:
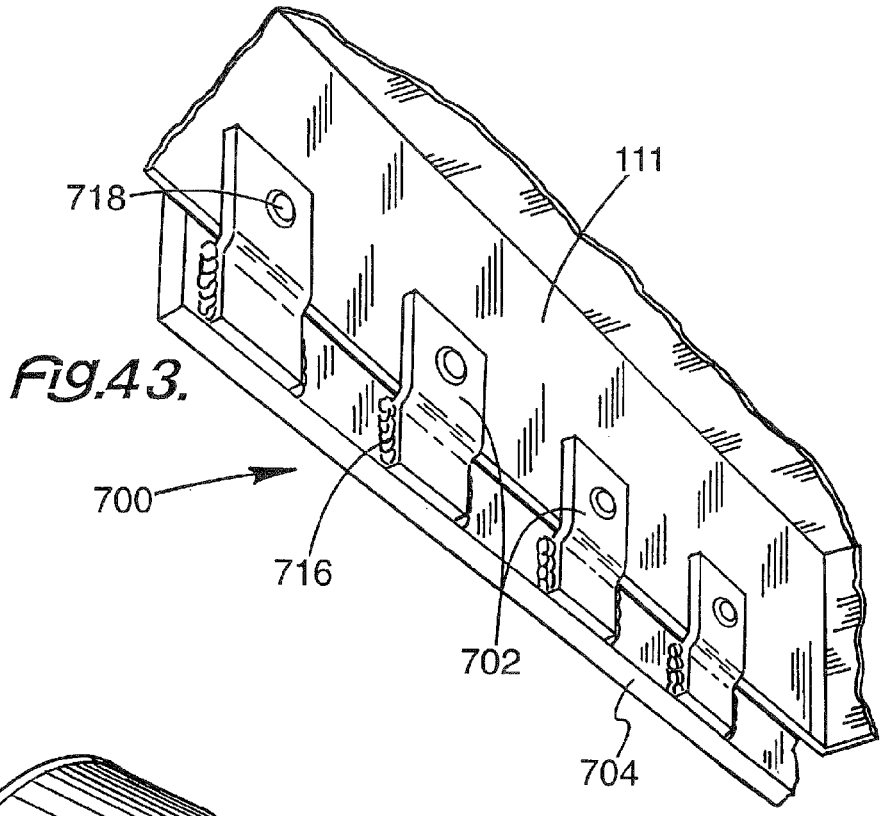
FIG. 43 depicts an inside perspective view of tabs 702 attached to fan base 111.

Now referring specifically to FIG. 43, the structure of fan support bar 704 can be clearly seen. Fan support bar 704 has tabs 702 secured to it. Welding 716 is the preferred method of securing tabs 702 to fan support bar 704. However any suitable securing mechanism, such as rivets and other fasteners, or any other method which provides a strong and stable connection between fan support bar 704 and tabs 702 can be utilized.

Tabs 702 are offset so they can accommodate fan base 111. Once fan base 111 is positioned, tabs 702 squeeze against fan base 111 to securely hold it in place. The connect between fasteners on fan support bar 704 and dimples 718 aid in creating a secure connection with fan base 111.

Referring specifically to FIG. 44, quick mount hinge with tabs 700 is depicted in open position 712. Once again, the interaction between fan rest 706 and locking plate 708, prevents the fan 110 from falling too far backwards. Open position 712 aids in cleaning vent and vent wall 108 for safety and cleanliness. Open position 712 can be any angle between fan support base 704 and mounting support bar 710. However, it is preferable that the angle be between 45 and 90 degrees. More preferably, the angle is between 60 and 85 degrees. Most preferable, the angle is between 81 and 84 degrees to support the weight of the fan 110 in open position 712. Spring loaded locking pin 440 also can position the fan 110 in other desired cleaning positions. Preferably, fan 110 is positioned between a 20 and 60 degree angle relative to mounting support bar 710. More preferably, fan 110 is positioned between a 30 and 50 degree angle relative to mounting support bar 710. Most preferably, fan 110 is positioned between a 41 and 46 degree angle relative to mounting support bar 710.

Referring specifically to FIG. 45, the lockdown position 714 of quick mount hinge with tabs 700 can be clearly seen. Quick mount hinge with tabs 700 remains in lockdown position 714 unless it is opened for cleaning, maintenance, or other purposes. The lockdown position 714 can also be applied to the hinges depicted in FIG. 1 through FIG. 41.

Lockdown position 714 creates a secure and stable position for safety and security issues. When quick mount hinge with tabs 700 is in lockdown position 714, spring loaded locking pin 440 securely locks it in position. Thus, hinge 700 cannot be opened by trespassers or other unauthorized individuals, or high winds or other environment factors.

Also FIG. 45, shows the geometry of quick mount hinge with tabs 700. As seen in the previous embodiments, the locking plate 708, the fan rest 706, and the ends of fan support bar 704 and mounting support bar 710 are clearly behind the vent wall 108. Quick mount hinge with tabs 700 hinges due to interactions with locking plate 708. Since the hinging, and positioning of spring loaded locking pin 440), occurs behind vent wall 108, it allows the fan base 111 to lift up, off, and back to prevent any binding due to the over lap of fan base 111 and vent wall 108.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A mounting hinge assembly configured to connect to a fan assembly positioned on a roof or wall, the fan assembly being defined by a fan secured to a fan base that is positionable over a vent on the roof or wall, the mounting hinge assembly provides for an easy cleaning and servicing procedure for both the fan and the vent on the roof or wall, the mounting hinge assembly comprising:

a pair of hinge sides, each hinge side including:

a fan base support bar having a fan base mounting section and a fan base support arm extending from the fan base mounting section, the fan base support arm having an upper edge and a lower portion, the lower portion having at least one tab extending outwardly and upwardly towards the upper edge and being opposed to the fan base support arm such that a channel is formed between the at least one tab the fan base support arm, the at least one tab having an aperture aligned with at least one opening on the fan base support arm, and at least one fastener configured to be inserted through the at least one aligned aperture and opening capturing a portion of the fan base resting in the channel;

a surface support bar having a surface support mounting section and a surface support arm extending from the surface support mounting section, the surface support arm having at least one surface support opening configured to receive a mounting fastener to secure the surface support bar to a surface defined on the vent, roof, or wall;

a hinge plate mutually connecting the fan base mounting section to the surface support mounting section such that the fan base support bar is moveable in relationship to the surface support bar, the hinge plate having a hinge plate opening corresponding to a hinge support opening positioned on either the fan base mounting section or the surface support mounting section, a hinge fastener securing through the hinge plate opening and the hinge support opening thereby hingedly securing the hinge plate to either the fan base mounting section or the surface support mounting section, and the hinge plate further having at least one adjustment aperture corresponding to at least one aperture on the fan base mounting section or the surface support mounting section, and an adjustment fastener securing through the at least one adjustment aperture and corresponding aperture on the fan base mounting section or the surface support mounting section, thereby securing the hinge plate to either the fan base mounting section or the surface support mounting section, whereby the surface support bar is hingedly connected to the fan base support bar; and each hinge side is thereby configured to be secured to the fan assembly, by securing at least a portion of the fan base in the channel between the at least one tab the fan base support arm and fastening the at least one fastener through the opening in the tab through the fan base and into the aligned aperture on the fan base support arm, and securing by at least one mounting fastener the surface support arm to either a surface of the vent below the fan base or a surface of the roof or wall, such that the fan base is moveable from vent.

2. The assembly of claim 1 further comprising at least one shim secured between the surface support bar and the fan base support bar by the adjustment fastener.

3. The assembly of claim 1, wherein the at least one adjustment aperture is further defined as pairs of adjustment apertures vertically aligned along the hinge plate such that either the fan base mounting section or the surface support mounting section can be adjusted vertically along the hinge plate when secured thereto.

4. The assembly of claim 1, wherein the fan base support arm has a ledge extending laterally from the upper edge thereof and away from the surface support bar, the ledge being configured for position onto an upper surface of the fan base.

5. The assembly of claim 1, wherein the ledge includes at least one aperture configured to receive a fastener to secure the ledge to the upper surface of the fan base.

6. The assembly of claim 1, wherein the at least one tab is further defined as a plurality of tabs each being opposed to the fan base support arm and each of the plurality of tabs being spaced apart from each other, each tab having an aperture configured for alignment with at least one opening defined on the fan base support arm.

7. The assembly of claim 1, wherein the at least one tab is a single tab extending along and being opposed to a portion of a length of the fan base support arm and the single tab having a plurality of apertures separately configured for alignment with a plurality of openings defined along the fan base support arm.

8. The assembly of claim 1, wherein the opening on the fan base support arm corresponding to the aperture on the tab is a threaded opening.

9. The assembly of claim 1 further comprising a first locking pin aperture positioned in the hinge plate and a corresponding locking pin aperture positioned on either the fan base mounting section or the surface support mounting section and at least one locking pin which when inserted into the aligned locking pin apertures movement of the fan base support arm with respect to the surface support bar is prevented.

10. The assembly of claim 9 further comprising a second locking pin aperture positioned in the hinge plate that aligns with the locking pin aperture positioned on either the fan base mounting section or the surface support mounting section when the fan base support arm is moved with respect to the surface support bar such that the locking pin inserted into the aligned second locking pin aperture and into the corresponding locking pin aperture positioned on either the fan base mounting section or the surface support mounting section is capable of securing the hinge side in an opened positioned providing access to the fan assembly.

11. The assembly of claim 1 further comprising a lateral arm extending from a rear portion of an upper edge of the fan base support arm, the lateral arm further extending towards the mounting plate, such that when the fan base support bar is moved with respect to the surface support bar, the lateral arm come into contact with the hinge plate preventing over extension of the fan base support bar with respect to the surface support bar.

12. A mounting hinge assembly configured to connect to a fan assembly positioned on a roof or wall, the fan assembly being defined by a fan secured to a fan base that is positionable over a vent on the roof or wall, the mounting hinge assembly provides for an easy cleaning and servicing procedure for both the fan and the vent on the roof or wall, the mounting hinge assembly comprising:

a pair of hinge sides, each hinge side including:

a fan base support bar having a fan base mounting section and a fan base support arm extending from the fan base mounting section, the fan base support arm having an upper edge and a lower portion, the lower portion having at least one tab extending outwardly and upwardly towards the upper edge and being opposed to the fan base support arm such that a channel is formed between the at least one tab the fan base support arm;

a surface support bar having a surface support mounting section and a surface support arm extending from the surface support mounting section, the surface support arm having at least one surface support opening configured to receive a mounting fastener to secure the surface support bar to a surface defined on the vent, roof, or wall;

a hinge plate mutually connecting the fan base mounting section to the surface support mounting section such that the fan base support bar is moveable in relationship to the surface support bar, the hinge plate having a hinge plate opening corresponding to a hinge support opening positioned on either the fan base mounting section or the surface support mounting section, a hinge fastener securing through the hinge plate opening and the hinge support opening thereby hingedly securing the hinge plate to either the fan base mounting section or the surface support mounting section, and the hinge plate further having at least one adjustment aperture corresponding to at least one aperture on the fan base mounting section or the surface support mounting section, and an adjustment fastener securing through the at least one adjustment aperture and corresponding aperture on the fan base mounting section or the surface support mounting section, thereby securing the hinge plate to either the fan base mounting section or the surface support mounting section, whereby the surface support bar is hingedly connected to the fan base support bar; and each hinge side is thereby configured to be secured to the fan assembly, by positioning at least a portion of the fan base in the channel between the at least one tab the fan base support arm, and securing by at least one mounting fastener the surface support arm to either a surface of the vent below the fan base or a surface of the roof or wall, such that the fan base is moveable from vent.

13. The hinge assembly of claim 12, wherein the at least one tab has an aperture aligned with at least one opening on the fan base support arm, and at least one fastener configured to be inserted through the at least one aligned aperture and opening capturing a portion of the fan base resting in the channel.

14. The assembly of claim 12, wherein the at least one tab is further defined as a plurality of tabs each being opposed to the fan base support arm and each of the plurality of tabs being spaced apart from each other, each tab having an aperture configured for alignment with at least one opening defined on the fan base support arm.

15. The assembly of claim 12, wherein the at least one tab is a single tab extending along and being opposed to a portion of a length of the fan base support arm and the single tab having a plurality of apertures separately configured for alignment with a plurality of openings defined along the fan base support arm.

* * * * *